US011459661B2

(12) United States Patent
Taylor et al.

(10) Patent No.: US 11,459,661 B2
(45) Date of Patent: Oct. 4, 2022

(54) CORROSION PREVENTATIVE SYSTEMS

(71) Applicant: Process4, Inc., Chagrin Falls, OH (US)

(72) Inventors: Curtis Taylor, Chagrin Falls, OH (US); Matthew Hanson, Chagrin Falls, OH (US)

(73) Assignee: PROCESS4, INC., Chagrin Falls, OH (US)

( * ) Notice: Subject to any disclaimer, the term of this patent is extended or adjusted under 35 U.S.C. 154(b) by 0 days.

(21) Appl. No.: 16/850,280

(22) Filed: Apr. 16, 2020

(65) Prior Publication Data

US 2020/0332422 A1 Oct. 22, 2020

Related U.S. Application Data

(63) Continuation-in-part of application No. 16/506,132, filed on Jul. 9, 2019, now Pat. No. 10,982,925.

(60) Provisional application No. 62/834,546, filed on Apr. 16, 2019, provisional application No. 62/828,527, filed on Apr. 3, 2019, provisional application No. 62/696,567, filed on Jul. 11, 2018.

(51) Int. Cl.
*C23F 11/02* (2006.01)

(52) U.S. Cl.
CPC ..... *C23F 11/02* (2013.01)

(58) Field of Classification Search
None
See application file for complete search history.

(56) References Cited

U.S. PATENT DOCUMENTS

| | | | | |
|---|---|---|---|---|
| 2,465,163 | A | 3/1949 | Lockwood | |
| 3,849,923 | A | 11/1974 | Hawkins | |
| 4,100,693 | A | 7/1978 | Cech | |
| 6,551,552 | B1 * | 4/2003 | Lyublinski | C23F 11/00 422/9 |
| 6,708,438 | B1 | 3/2004 | Sorensen | |
| 6,783,117 | B2 * | 8/2004 | Wohrle | A61L 9/035 261/104 |
| 7,449,154 | B2 * | 11/2008 | Yamasaki | A01M 1/2055 422/125 |
| 8,377,531 | B2 * | 2/2013 | Lyublinski | B65D 81/24 428/35.7 |
| 9,656,201 | B2 * | 5/2017 | Gencer | B01D 53/261 |

OTHER PUBLICATIONS

Zerust, Anti-Tarnish Products, https://www.zerustproducts.com/products/product-category/anti-tarnish-products/, Jun. 3, 2021.

* cited by examiner

*Primary Examiner* — Reginald S Tillman, Jr.
(74) *Attorney, Agent, or Firm* — Ulmer & Berne LLP; Brian Eturung

(57) ABSTRACT

Corrosion preventative devices configured to be inserted within a storage container are disclosed. The exemplary corrosion preventative devices are made from or otherwise include a material configured to release corrosion protection molecules.

18 Claims, 19 Drawing Sheets

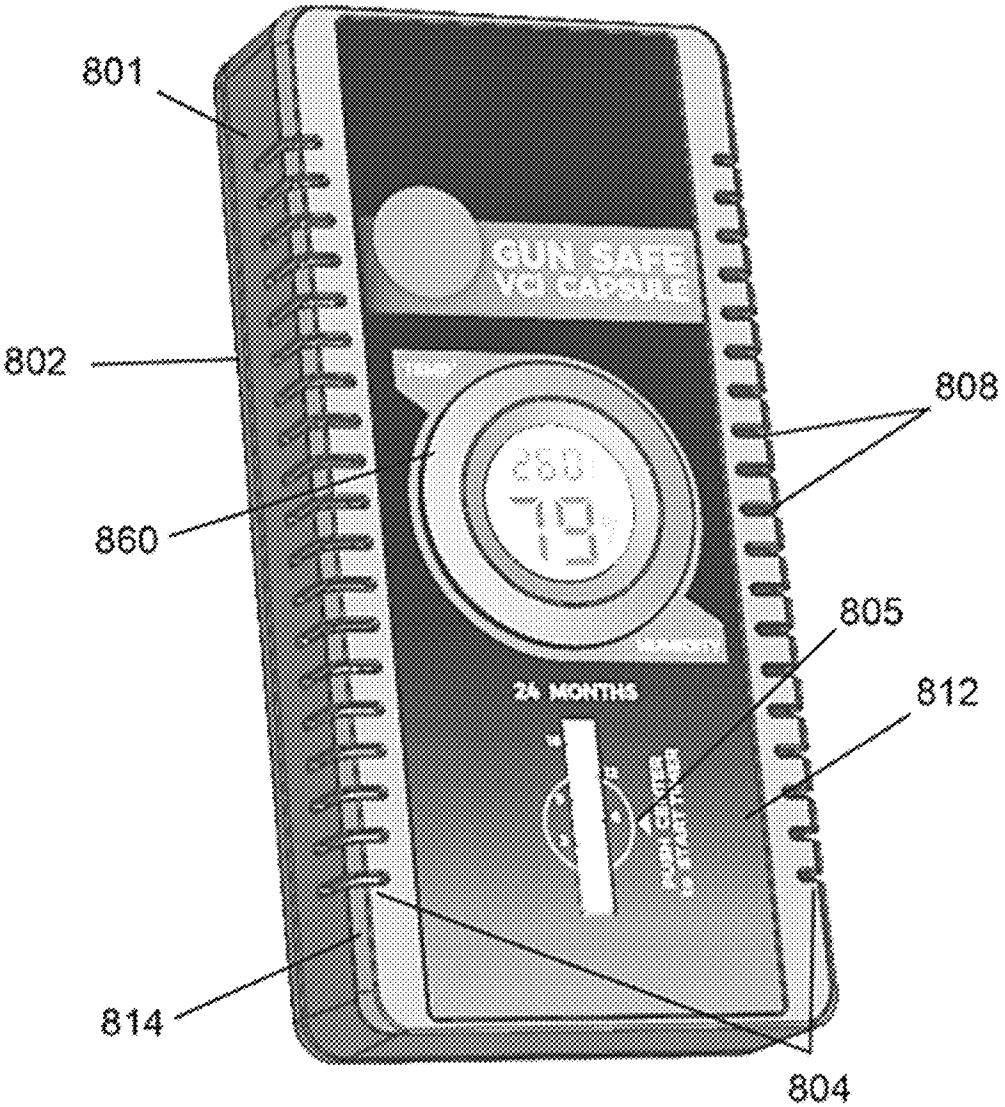
801
802
860
814
808
805
812
804
GUN SAFE
AR CASE
2008
PB
PB
PB

CORROSION PREVENTATIVE SYSTEMS

CROSS REFERENCE TO RELATED APPLICATIONS

This application claims priority to U.S. Provisional Application No. 62/834,546 filed Apr. 16, 2019, the disclosure of which is herein incorporated by reference in its entirety.

The present invention is also a continuation-in part of U.S. application Ser. No. 16/506,132 filed Jul. 9, 2019, which claims priority on U.S. patent application Ser. Nos. 62/696,567 filed Jul. 11, 2018 and 62/828,527 filed Apr. 3, 2019, which are incorporated herein by reference.

The present disclosure is directed to corrosion preventative systems that are configured to release corrosion protection molecules, more particularly to corrosion preventative systems that are configured to be inserted inside safes, containers, firearms, and the like and to release corrosion protection molecules to inhibit or prevent oxidation and rusting of metal objects, and still more particularly to corrosion preventative systems that are configured to be inserted inside safes, containers, firearms, and the like and to release corrosion protection molecules to inhibit or prevent oxidation and rusting of metal objects, and which corrosion preventative systems include a time and/or date indicator to provide to the user information on the status and/or expiration period of the corrosion preventative system.

BACKGROUND

Corrosion and rust are major problems associated with the storage of metallic articles, including tools, firearms, and the like. Moisture present in a storage container causes the metal components of such articles to corrode, tarnish, and rust, in turn degrading the performance of the article and potentially inducing permanent damage. Rust-inhibiting diffuser products provide initial protection against rust and corrosion by continuously releasing specialized chemicals into the surrounding air. The current diffuser products are limited because they fail to meaningfully communicate the effective status of the rust-inhibiting product. That is, a rust-inhibiting diffuser product can be placed in a storage container and forgotten. Over time, the rust-inhibiting properties are reduced to the point where rust and corrosion are allowed to affect the metallic articles.

In view of the prior art, there remains a need for improved rust-inhibiting devices that include one or more components and/or structural features that meaningfully communicate the effective status of the diffuser product, e.g., alerting one to an expired state of the specialized chemical/device and/or provide environment information.

BRIEF DESCRIPTION

The present disclosure is directed to corrosion preventative systems that are configured to release corrosion protection molecules, more particularly to corrosion preventative systems that are configured to be inserted inside safes, containers, firearms, and the like and to release corrosion protection molecules to inhibit or prevent oxidation and rusting of metal objects, and still more particularly to corrosion preventative systems that are configured to be inserted inside safes, containers, firearms, and the like and to release corrosion protection molecules to inhibit or prevent oxidation and rusting of metal objects, and which corrosion preventative systems include a time and/or date indicator to provide to the user information on the status and/or expiration period of the corrosion preventative system.

One non-limiting aspect of the present disclosure is to provide a corrosion preventative device configured to emit vapor from a corrosion-inhibiting material to protect articles that are located in close proximity to the corrosion preventative device (e.g., 0-10 feet and all values and ranges therebetween). The corrosion preventative device includes a body which includes an interior cavity, at least one vent formed of one or more apertures, and a timing element. The interior cavity is configured to house the corrosion-inhibiting material and the at least one vent is configured to release the corrosion protection molecules of the corrosion-inhibiting material from the interior cavity of the body. The corrosion protection molecules are in the form of a gas or vapor that can pass from the cavity of the body and through the one or more vents. The timing element is configured to provide information to a user regarding the operational time of the corrosion preventative device. As such, the timing element can be used to provide the user with 1) the amount of remaining time that the corrosion preventative device will actively release the corrosion protection molecules, 2) the date or time period that the corrosion preventative device was activated to start the release the corrosion protection molecules, and/or 3) the date or time period that the corrosion preventative device will or is expected to stop release of the corrosion protection molecules. As such, the timing element can be used to inform the user when the corrosion preventative device need to be replaced and whether the corrosion preventative device is still functioning. The size, shape, configuration, and materials of the body are non-limiting.

Another and/or alternative non-limiting aspect of the present disclosure is that the timing element optionally includes a migration medium. The migration medium (when used) is configured to permit a flow of liquid across the migration medium. The flow of liquid across the migration medium can be used to 1) indicate when the timing element was activated (e.g., day, month, year, season [e.g., winter, spring, summer, winter], etc.), 2) the time period that the timing element has been activated (hours, days, weeks, months, year, etc.), 3) indicate the remaining life period of the corrosion preventative device (e.g., percentage of use and/or percentage of remaining life [e.g. 0%-100% and all values and ranges therebetween], etc.), and/or 4) indicate that the corrosion preventative device has expired (e.g., no further corrosion protection molecules of the corrosion-inhibiting material are flowing from the body of the corrosion preventative device, or an insufficient amount of corrosion protection molecules of the corrosion-inhibiting material are flowing from the body of the corrosion preventative device to provide corrosion protection to metals about the corrosion preventative device), or is about to expire.

Another and/or alternative non-limiting object of the present disclosure is that the timing element optionally includes a button and/or depression region which is configured to rupture a sealed reservoir containing the fluid. The depression of the button and/or depression region can be used by the user to activate the timing element.

Another and/or alternative non-limiting object of the present disclosure is that the timing element optionally includes one or more lights (e.g. LEDs, etc.) configured to illuminate based on the operational time of the corrosion preventative device. The one or more lights can be used to indicate that 1) the timing element was activated, 2) the time period that the timing element has been activated (hours, days, weeks, months, year, etc.), 3) the remaining life period of the corrosion preventative device, and/or 4) the corrosion preventative device has expired or is about to expire. In one non-limiting arrangement, the corrosion preventative device includes an LED that indicates that the corrosion preventative device has been activated. In another non-limiting arrangement, the corrosion preventative device includes an LED that indicates that the corrosion preventative device has or is about to expire. In another non-limiting arrangement, the corrosion preventative device includes a plurality of LEDs wherein each illumination or non-illumination of the LED represents a percentage of use or remaining usage of the corrosion preventative device.

Another and/or alternative non-limiting aspect of the present disclosure is that the timing element optionally includes a time indicator panel. The time indicator panel (when used) includes time information in the form of date information and/or seasonal information corresponding to 1) the time that the corrosion preventative device was activated, 2) the time period that the timing element has been activated, 3) indicate the remaining life period of the corrosion preventative device, and/or 4) indicate that the corrosion preventative device has expired or is about to expire. In one non-limiting embodiment, the time indicator panel includes a region that allows a user to manually mark, punch-out, or create another type of visual indicator to enable the user to indicate when the corrosion preventative device was activated.

Another and/or alternative non-limiting aspect of the present disclosure is that the timing element optionally includes a deformable and/or puncturable element oriented over one or more recess cavities formed in the body of the corrosion preventative device. In one non-limiting arrangement, the timing element includes a plurality of recess cavities closely positioned to one another (e.g., 0.01-10 mm and all values and ranges therebetween) and a deformable and/or puncturable element in the form of a film (e.g., paper, plastic, etc.) that is positioned partially or fully over the plurality of recess cavities, wherein the film can be marked and/or punctured by a user. The deformable and/or puncturable element may optionally include markings (e.g., month, day, year, seasons, etc.). The markings can be optionally used in the deformable and/or puncturable element to enable the user to mark and/or puncture an appropriate location on the deformable and/or puncturable element to indicate 1) the beginning use date of the corrosion preventative device, 2) the expected expiration time or period of the corrosion preventative device, etc. When the deformable and/or puncturable element is designed to be punctured or otherwise deformed by the user, the recess cavity located beneath a region of the deformable and/or puncturable element facilitates in enabling the deformable and/or puncturable element to be punctured and/or deformed by the user. In another non-limiting embodiment, the body of the corrosion preventative device can optionally include markings (e.g., month, day, year, seasons, etc.). The markings can be optionally used to enable the user to mark and/or puncture an appropriate location on the deformable and/or puncturable element to indicate 1) the beginning use date of the corrosion preventative device, 2) the expected expiration time or period of the corrosion preventative device, etc. Such markings (when used) can be located adjacent to the deformable and/or puncturable element.

Another and/or alternative non-limiting aspect of the present disclosure is to provide a timing element that is optionally configured to be connected to the body of the corrosion preventative device. The type of connection arrangement is non-limiting (e.g., adhesive, melted seam, mechanical connection [e.g., snap, friction connection, slot, tongue and groove, rivet, zipper, etc.], hook and loop fastener, etc.).

Another and/or alternative non-limiting aspect of the present disclosure is to provide a timing element that is optionally integrated with the body of the corrosion preventative device.

Another and/or alternative non-limiting object of the present disclosure is to provide a timing element that is optionally integrated with a packaging material of the corrosion preventative device.

Another and/or alternative non-limiting aspect of the present disclosure is to optionally provide a communication interface that is configured to communicate with a remote device and transmit information (e.g., operational time of corrosion preventative device, expiration of corrosion preventative device, warning that corrosion preventative device has expired or will expire soon (e.g., in one month, in one or more days, etc.), reminder to change/check corrosion preventative device, concentration of corrosion protection molecules, temperature, time, humidity, pressure, remaining life of corrosion preventative device, percentage of use life of corrosion preventative device already used, time of useful life of corrosion preventative device, etc.) to the remote device (e.g., tablet, smart phone, computer, cloud, hub, etc.). The information that is transmitted by the corrosion preventative device can be used by the user to remotely monitor the operation/status of the corrosion preventative device and/or enable the user to timely change out the corrosion preventative device.

Another and/or alternative non-limiting aspect of the present disclosure is that the body of the corrosion preventative device optionally includes a top cover and a base, wherein the top cover is configured to connect to the base and define an interior cavity of the body.

Another and/or alternative non-limiting aspect of the present disclosure is that the body of the corrosion preventative device optionally includes an outward material projection configured to facilitate mounting of the corrosion preventative device in a desired location.

Another and/or alternative non-limiting aspect of the present disclosure is to optionally provide one or more tethering mechanisms configured to mount the corrosion preventative device in a desired location.

Another and/or alternative non-limiting aspect of the present disclosure is to provide a method for protecting one or more metallic articles which includes providing a corrosion preventative device configured to emit a corrosion-inhibiting material to protect the one or more metallic articles. The corrosion preventative device includes a body and a timing element. The body includes an interior cavity and at least one vent formed of one or more apertures. The interior cavity is configured to house the corrosion-inhibiting material. The one or more apertures are configured to release gas and/or vapor of the corrosion-inhibiting material from the interior cavity. The timing element is configured to provide information to a user regarding the operational time of the corrosion preventative device. The method includes the placing of the corrosion preventative device in a receptacle (e.g., gun barrel, etc.), container, safe, etc., to enable the corrosion preventative device to inhibit oxidation and/or corrosion of metals about the corrosion preventative device.

Another and/or alternative non-limiting aspect of the present disclosure is to provide for the displaying of the operational time to indicate an amount of time the corrosion preventative device actively releases gas and/or vapor, and/or a remaining life of the corrosion preventative device.

Another and/or alternative non-limiting aspect of the present disclosure is to optionally provide for the transmitting of the operational time of the corrosion preventative device to a remote device.

Another and/or alternative non-limiting aspect of the present disclosure is to provide a system configured to emit gas and/or vapor from a corrosion-inhibiting material to protect metallic articles. The system includes a corrosion preventative device. The corrosion preventative device includes a body and a timing element. The body includes an interior cavity and at least one vent formed of one or more apertures. The interior cavity is configured to house the corrosion-inhibiting material. The one or more apertures are configured to release gas and/or vapor of the corrosion-inhibiting material from the interior cavity. The timing element is configured to provide information to a user regarding the operational time of the corrosion preventative device. The corrosion preventative device is configured to be placed in a receptacle (e.g., gun barrel, etc.), container, safe, etc., to enable the corrosion preventative device to inhibit oxidation and/or corrosion of metals about the corrosion preventative device. The corrosion preventative device can be optionally mounted within the receptacle. The corrosion preventative device can optionally include a digital or non-digital display/indicator configured to provide operational time information of the corrosion preventative device to a user. The corrosion preventative device can optionally include a transmitter that transmits information to a remote device regarding the corrosion preventative device and/or conditions about the corrosion preventative device.

One non-limiting object of the present disclosure is the provision of a corrosion preventative device configured to emit gas and/or vapor from a corrosion-inhibiting material to protect materials from oxidation and/or corrosion.

Another and/or alternative non-limiting object of the present disclosure is the provision of a corrosion preventative device that includes a body having an interior cavity, and a timing element. The body includes at least one vent formed of one or more apertures. The interior cavity is configured to house a corrosion-inhibiting material. The one or more apertures are configured to release gas and/or vapor of the corrosion-inhibiting material from the interior cavity. The timing element configured to indicate an operational time of the corrosion preventative device.

Another and/or alternative non-limiting object of the present disclosure is the provision of a corrosion preventative device wherein the operational time is indicative of 1) the amount of remaining time that the corrosion preventative device will actively release the corrosion protection molecules, 2) the date or time period that the corrosion preventative device was activated to start the release the corrosion protection molecules, and/or 3) the date or time period that the corrosion preventative device will or is expected to stop release the corrosion protection molecules.

Another and/or alternative non-limiting object of the present disclosure is the provision of a corrosion preventative device wherein the timing element comprises a migration medium. The migration medium can be configured to permit a flow of liquid across the migration medium. The flow of liquid across the migration medium can be used to 1) indicate when the timing element was activated, 2) the time period that the timing element has been activated, 3) indicate the remaining life period of the corrosion preventative device, and/or 4) indicate that the corrosion preventative device has expired or is about to expire.

Another and/or alternative non-limiting object of the present disclosure is the provision of a corrosion preventative device wherein the timing element includes a button, wherein the button is configured to rupture a sealed reservoir containing fluid. The depression of the button and/or depression region can be used by the user to activate the timing element.

Another and/or alternative non-limiting object of the present disclosure is the provision of a corrosion preventative device wherein the timing element includes one or more lights configured to illuminate based on the operational time of the corrosion preventative device. The one or more lights can be used to 1) indicate that the timing element was activated, 2) the time period that the timing element has been activated, 3) indicate the remaining life period of the corrosion preventative device, and/or 4) indicate that the corrosion preventative device expired or is about to expire.

Another and/or alternative non-limiting object of the present disclosure is the provision of a corrosion preventative device wherein the timing element includes a time indicator panel. The time indicator panel includes time information in the form of date information and/or seasonal information corresponding to 1) the time the corrosion preventative device was activated, 2) the time period that the timing element has been activated, 3) indicate the remaining life period of the corrosion preventative device, and/or 4) indicate that the corrosion preventative device expired or is about to expire.

Another and/or alternative non-limiting object of the present disclosure is the provision of a corrosion preventative device wherein the timing element includes a time indicator panel that includes a region that allows a user to manually mark, punch-out, or create another type of visual indicator to enable the user to indicate when the corrosion preventative device was activated.

Another and/or alternative non-limiting object of the present disclosure is the provision of a corrosion preventative device wherein the timing element includes a deformable and/or puncturable element oriented over one or more recess cavities formed in the body of the corrosion preventative device.

Another and/or alternative non-limiting object of the present disclosure is the provision of a corrosion preventative device wherein the timing element includes a deformable and/or puncturable element includes markings to enable the user to mark and/or puncture an appropriate location on the deformable and/or puncturable element to indicate 1) the beginning use date of the corrosion preventative device, 2) the expected expiration time or period of the corrosion preventative device, etc.

Another and/or alternative non-limiting object of the present disclosure is the provision of a corrosion preventative device wherein the timing element includes a deformable and/or puncturable element wherein a recess cavity is located beneath a region of the deformable and/or puncturable element to facilitate in enabling the deformable and/or puncturable element to be punctured and/or deformed by the user.

Another and/or alternative non-limiting object of the present disclosure is the provision of a corrosion preventative device wherein the body of the corrosion preventative device includes markings to enable the user to mark and/or puncture an appropriate location on the deformable and/or puncturable element to indicate 1) the beginning use date of the corrosion preventative device, 2) the expected expiration time or period of the corrosion preventative device, etc.

Another and/or alternative non-limiting object of the present disclosure is the provision of a corrosion preventative device wherein the body of the corrosion preventative device includes markings located adjacent to the deformable and/or puncturable element.

Another and/or alternative non-limiting object of the present disclosure is the provision of a corrosion preventative device that includes a communication interface configured to communicate with a remote device and transmit information to a remote device.

Another and/or alternative non-limiting object of the present disclosure is the provision of a corrosion preventative device that includes a communication interface used by the user to remotely monitor the operation/status of the corrosion preventative device, and/or to enable the user to timely change out the corrosion preventative device.

Another and/or alternative non-limiting object of the present disclosure is the provision of a method for protecting one or more metallic articles which includes providing 1) a corrosion preventative device configured to emit a corrosion-inhibiting material to protect the one or more metallic articles, wherein the corrosion preventative device includes a body and a timing element, wherein the body includes an interior cavity and at least one vent formed of one or more apertures, wherein the interior cavity is configured to house the corrosion-inhibiting material, wherein the one or more apertures are configured to release gas and/or vapor of the corrosion-inhibiting material from the interior cavity, wherein the timing element is configured to provide information to a user regarding the operational time of the corrosion preventative device, 2) placing the corrosion preventative device in a receptacle to enable the corrosion preventative device to inhibit oxidation and/or corrosion of material (e.g., metals, etc.) about the corrosion preventative device.

Another and/or alternative non-limiting object of the present disclosure is the provision of a method for protecting one or more metallic articles which includes displaying of the operational time to indicate an amount of time the corrosion preventative device actively releases gas and/or vapor, and/or a remaining life of the corrosion preventative device.

Another and/or alternative non-limiting object of the present disclosure is the provision of a method for protecting one or more metallic articles which includes transmitting operational time information of the corrosion preventative device to a remote device.

Another and/or alternative non-limiting object of the present disclosure is the provision of a system configured to emit gas and/or vapor from a corrosion-inhibiting material to protect materials. The system includes a corrosion preventative device. The corrosion preventative device includes a body and a timing element. The body includes an interior cavity and at least one vent formed of one or more apertures. The interior cavity is configured to house the corrosion-inhibiting material. The one or more apertures are configured to release gas and/or vapor of the corrosion-inhibiting material from the interior cavity. The timing element is configured to provide information to a user regarding the operational time of the corrosion preventative device. The corrosion preventative device is configured to be placed in a receptacle to enable the corrosion preventative device to inhibit oxidation and/or corrosion of material about the corrosion preventative device.

Another and/or alternative non-limiting object of the present disclosure is the provision of a system configured to emit gas and/or vapor from a corrosion-inhibiting material to protect materials wherein a corrosion preventative device includes a digital or non-digital display/indicator configured to provide operational time information of the corrosion preventative device to a user.

Another and/or alternative non-limiting object of the present disclosure is the provision of a system configured to emit gas and/or vapor from a corrosion-inhibiting material to protect materials wherein a corrosion preventative device includes a transmitter that transmits information to a remote device regarding the corrosion preventative device and/or conditions about the corrosion preventative device.

These and other objects and advantages will become apparent from the discussion of the distinction between the disclosure and the prior art and when considering the preferred embodiment shown in the accompanying drawings.

BRIEF DESCRIPTION OF THE DRAWINGS

Reference may now be made to the drawings, which illustrate various embodiments that the disclosure may take in physical form and in certain parts and arrangement of parts wherein:

FIGS. 1A-1D illustrate and show corrosion preventative device devices having a top cover and a base configured to house and release corrosion protection molecules;

FIGS. 2A-2D illustrate and show a corrosion preventative device with one or more body segments configured to house and release corrosion protection molecules;

FIGS. 3A-3B and 4A-4B show a corrosion preventative device including exemplary corrosion preventative device attachment mechanisms;

FIG. 5A shows a corrosion preventative device having a separate timing element or indicator attached thereto and FIGS. 5B-5D illustrate additional details of the exemplary timing element or indicator of FIG. 5A which are configured for use with the corrosion preventative device devices described herein;

FIGS. 6A-6C illustrate a corrosion preventative device configured as a snap cap to be placed within an associated firearm;

FIGS. 7A-7C illustrate and show a corrosion preventative device having an integrated timing element or indicator;

FIGS. 8A-8C are illustrations according to a non-limiting embodiment of the present disclosure, where FIGS. 8A-8C illustrate and show a corrosion preventative device having an integrated timing element or indicator and a digital display system;

FIG. 9 shows a corrosion preventative device in electronic communication with a remote device and a server device; and, FIG. 10 is an illustration according to one non-limiting embodiment of the present disclosure, where

DETAILED DESCRIPTION OF NON-LIMITING EMBODIMENTS

Figure 1A:
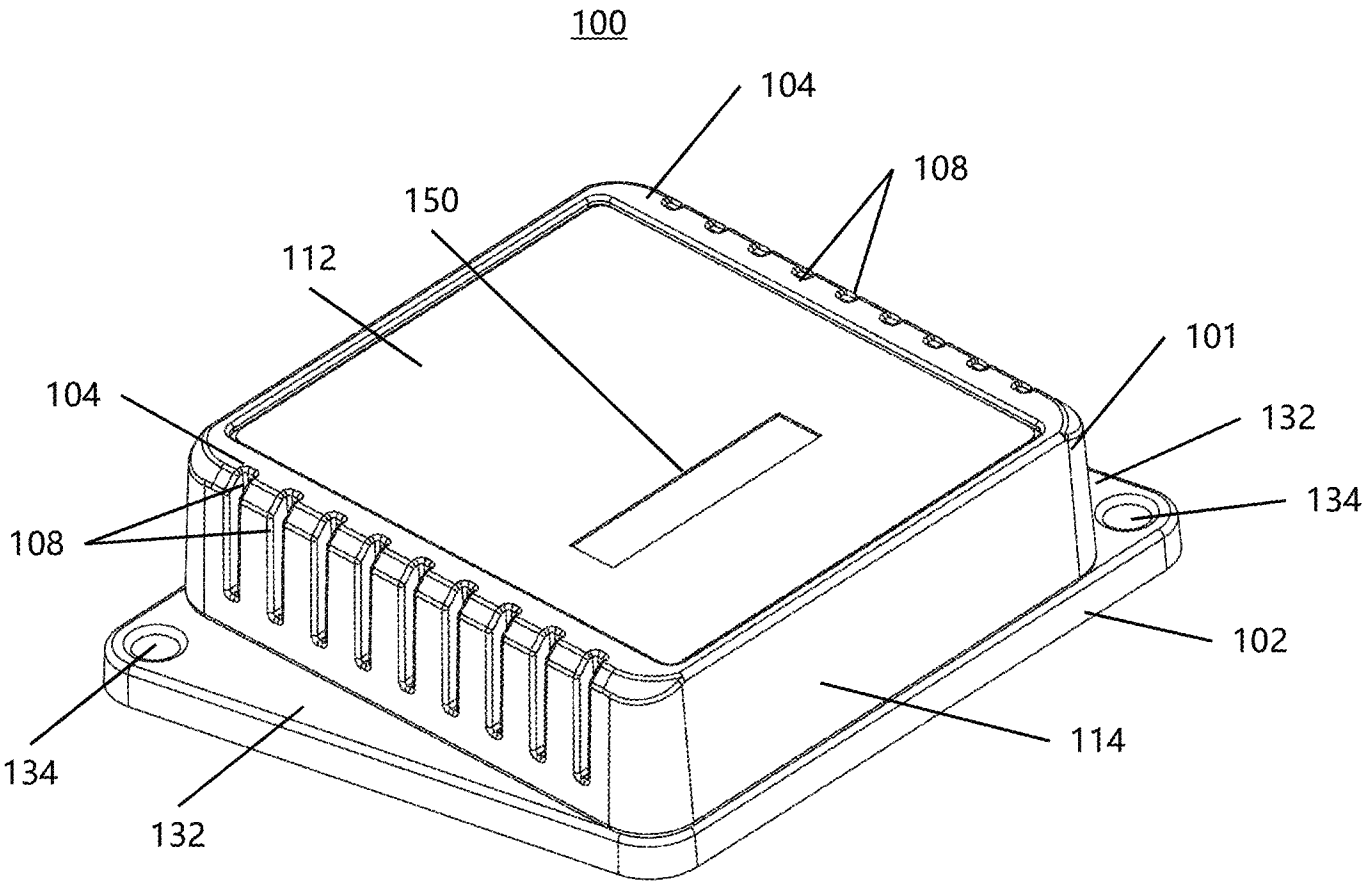
FIGS. 1A-1D are illustrations according to one non-limiting embodiment of the present disclosure, where

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, all the intermediate values and all intermediate ranges).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

The present disclosure generally relates to devices that emit vapor corrosion inhibitors which protect metallic articles from chemical reactions. Vapor corrosion inhibitors or volatile corrosion inhibitors (VCIs) are molecules that inhibit corrosion by forming a thin protective layer and/or vapor barrier on the surface of an object (e.g., metal object, etc.). The layer is invisible to the eye and prevents moisture and/or atmospheric elements (oxygen, carbon dioxide, ozone, ammonia, nitrogen dioxide, hydrogen sulfide, sulfur dioxide, and hydrogen chloride, etc.) from chemically reacting with the object. The molecules are generally contained within an enclosed space such as, but not limited to, a storage container and dissipate when the container is opened. One such VCI is known as Zerust® and is available from Northern Technologies International Corporation of Circle Pines Minnesota.

As discussed herein, the exemplary corrosion preventative devices described herein and shown in the corresponding figures are made from or otherwise include a material which releases molecules that protect against rust, corrosion, oxidation, and/or tarnish. These exemplary corrosion preventative devices include the corrosion preventative devices as illustrated and shown in FIGS. 1-10, and as discussed below. The presently disclosed corrosion preventative devices are configured to be placed within a storage container, such as the gun safe 1000 illustrated in FIG. 10, gun chamber, safe, container, or other receptacle formed of and/or including a material that is susceptible to rust, corrosion, oxidation, and/or tarnish from exposure to an ambient atmosphere (e.g., air, etc.). Moreover, the associated articles which are placed in the receptacle can generally be exposed to the environment for substantial periods of time. As such, the articles and their associated components are particularly susceptible to rust, corrosion, oxidation, and/or tarnish. However, by including the exemplary corrosion preventative devices described herein, rust, corrosion, oxidation, and/or tarnish can be prevented or otherwise delayed over the life of the articles during storage.

In order to provide rust, corrosion, oxidation, and/or tarnish protection, the corrosion preventative devices disclosed herein are made with or otherwise house a substance which inhibits volatile or vapor corrosion. The inhibiting behavior of the substance is enabled by a plurality of mechanisms. In general, the plurality of mechanisms enabling the inhibiting behavior of the substance all include the release of vapor into the air and/or the deposition of protective molecules on one or more exposed surfaces of the articles within the receptacle. In one exemplary inhibiting mechanism, the deposited molecules form a protective barrier against external dirt and/or gasses. The molecular barrier layer can inhibit electrochemical reactions on metal surfaces by blocking the diffusion of corrosive acid gas pollutants from the environment, thereby preventing contact between these corrosive gases and the metal surfaces. In another exemplary inhibiting mechanism, the deposited molecules form a molecular layer of corrosion inhibitors that passivate the electron flow between the anodic and cathodic areas on metal surfaces and interrupt the electrochemical corrosion process. In still another exemplary mechanism, the deposited molecules form a hydrophobic molecular layer that inhibits water from reaching the metal surface and forming the electrolyte necessary for corrosion reactions. In view of these non-limiting inhibiting mechanisms, the exemplary corrosion preventative devices advantageously shield against rust, tarnish, oxidation, and/or corrosion.

In some particular non-limiting embodiments, the protective material of the corrosion preventative devices is provided by use of a powder placed inside a vented corrosion preventative device body/enclosure that includes the vapor corrosion-inhibiting substance. In such configurations, the hollow interior of the corrosion preventative device body/enclosure are filled with the vapor corrosion-inhibiting powder. The one or more vents of the body/enclosure are configured to be sealed or receive a vented plug (not shown) which at least partially seals off the hollow interiors and prevents the vapor corrosion-inhibiting powder from spilling out of the hollow interior. In corrosion preventative devices configured similarly to corrosion preventative devices 100 illustrated in FIGS. 1A-1D, any vapor corrosion-inhibiting powder escaping out of the hollow interior and through the vents is permitted to permeate the local environment of a storage container. In some embodiments, the powder may be formed into pellets or bars, and optionally be bound together by an adhesive or polymer matrix material.

In some other non-limiting embodiments, the protective material of the exemplary corrosion preventative devices is provided by use of a barrier film infused or impregnated with the vapor corrosion-inhibiting substance. The film (not shown) covers some or all of the exterior profile of the corrosion preventative device body or the film may be placed therein. For example, the film can be made from plastics such as low-density polyethylene (LDPE) or metals such as aluminum. However, the particular material from which the barrier film is made is non-limiting. In such configurations, the corrosion preventative device bodies can be made from the same or different material as the barrier film and can be provided with or without their respective hollow interior regions. In some embodiments, a vapor corrosion-inhibiting substance is impregnated into plastic or molded with a plastic material such that the molded substance is configured to release the vapor corrosion-inhibiting substance into the environment. In some embodiments, the plastic material is polypropylene. In some embodiments, the vapor corrosion-inhibiting substance is from about 0.5 wt. % to about 40 wt. % (and all values and ranges therebetween) of the molded plastic piece, including but not limited to about 1, 1.25, 1.5, 1.75, 2, 2.5, 3, 3.5, and 4 wt. %.

In other non-limiting embodiments, the protective material of the corrosion preventative devices described herein is provided by use of a coating that includes the vapor corrosion-inhibiting substance. In such configurations, the coating is applied to a surface of the corrosion preventative device body or a host that is placed within the corrosion preventative device body. The corrosion preventative device body and/or host can be made from any suitable material (e.g., plastic, metal, etc.) able to be impregnated with the substance. In such configurations, the corrosion preventative device s can be provided with or without their respective hollow interiors. The coating including the vapor corrosion inhibiting substance can be water-based, grease-based, oil-based, etc., without departing from the scope of the present disclosure.

FIGS. 1A-1D illustrate an exemplary corrosion preventative device 100 in accordance with the present disclosure. The body of the corrosion preventative device 100 includes a base 102 and top cover 101. The top cover 101 may snap connect to base 102 and define a cavity or hollow interior volume 105 therein; however, other connection arrangement can be used (e.g., adhesive, screws, bolts, melted seam, solder, weld bead, etc.). The cavity 105 is configured to house a VCI protective material as described above. One or more vents 104 defined by a plurality of apertures 108 are disposed on the cover 101 and fully penetrate the top cover 101 and allow for vapor and molecules of the VCI protective material to be released from the interior cavity 105 of the corrosion preventative device 100. The position of the vents 104 and apertures 108 on the corrosion preventative device 100 are non-limiting. As illustrated in FIG. 1A, the vents 104 and apertures 108 are positioned on both the top surface 112 and two opposing sides of sidewall 114.

In some embodiments, the top cover 101 and base 102 each include a connection used to join the top cover and base together. In more particular embodiments, the base 102 optionally includes one or more cantilevered portions 115 and one or more outwardly extending hooks 117. The hooks 117 of the cantilevered portions 115 are configured to engage one or more corresponding recesses 119 located in the sidewall 114 in a snap-fit relationship. In some embodiments, the base 102 further includes one or more guide walls 121 extending between the cantilevered portions 115 and hooks 117. The one or more guide walls 121 are configured to guide the cantilevered portions 115 and hooks 117 of the base 102 into the interior cavity 105 of the top cover 101 such that the hooks can engage the corresponding recesses 119. It is to be appreciated that while cantilever, hook, slot, snap-fit connections are described herein as connection sets, other fasteners that either permanently connect or removably connect adjacent body segments 101 and 102 may be used.

In some embodiments and with reference to FIG. 1A, the corrosion preventative device 100 includes one or more fin sections 132 extending out from one or more sides of the base 102. The fins 132 are an outward projection of material that may be molded with the base 102. The fins 132 provide a structure for a user to grasp and hold the corrosion preventative device 100. The fins 132 may also facilitate the mounting of the corrosion preventative device 100 in a storage container described in greater detail below. In some embodiments, the fins 132 further include one or more corresponding fin holes 134 configured to facilitate mounting. In some embodiments, the fin holes 132 are configured to accommodate a fastener that is able to secure the corrosion preventative device 100 to a wall or portion of an associated storage container.

Figure 1C:
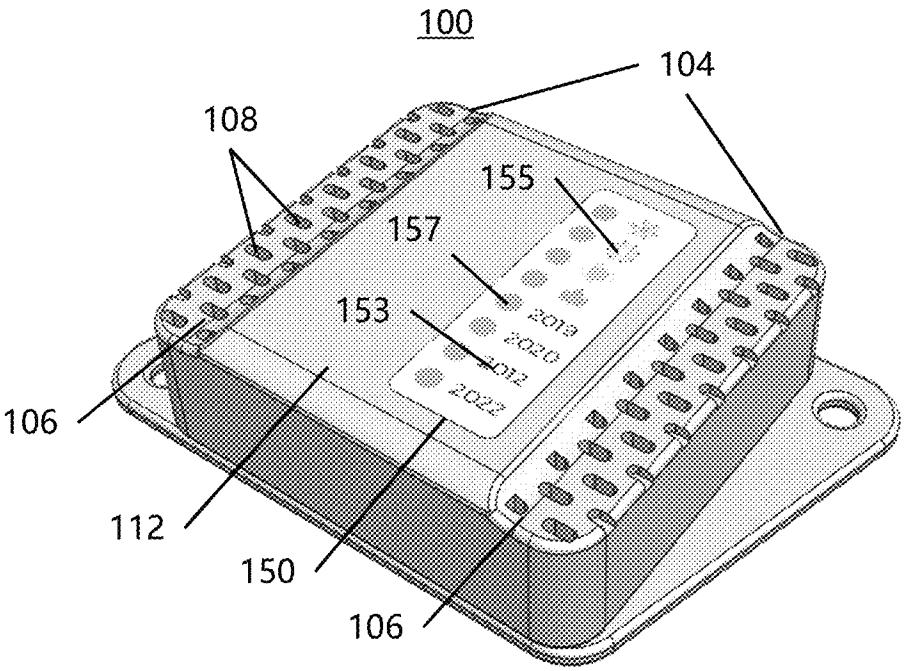
Figure 1B:
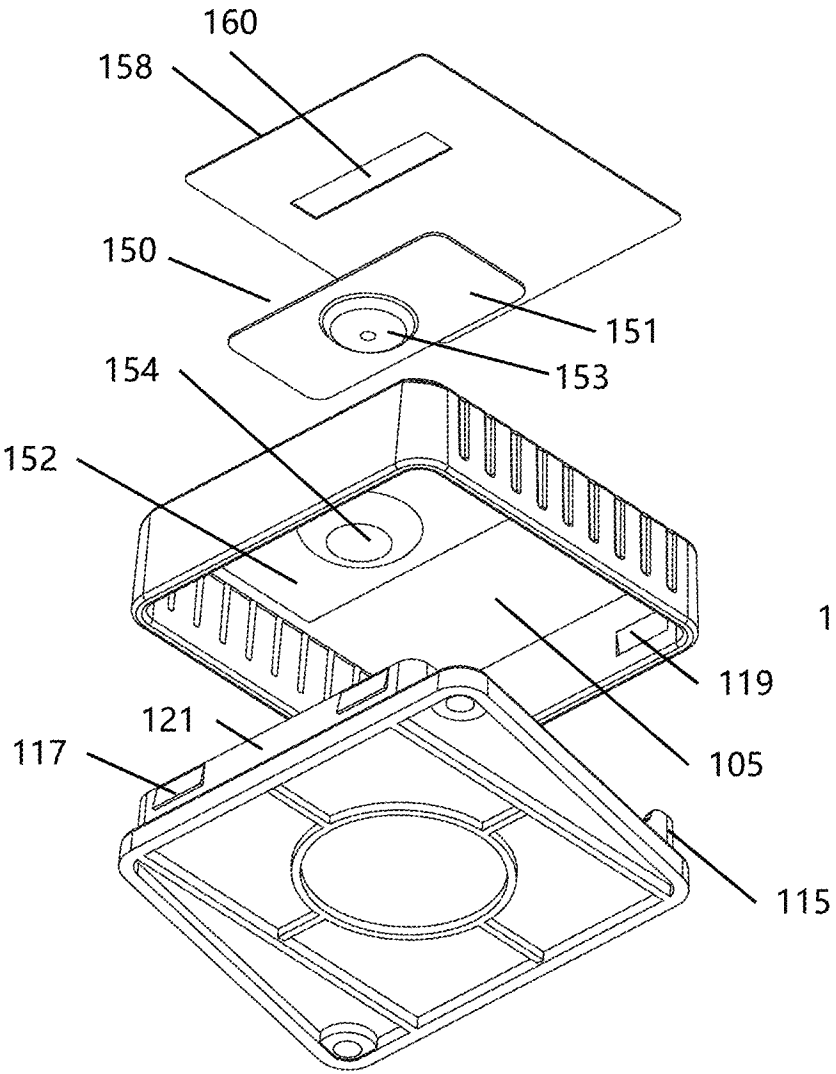

In accordance with another aspect of the present disclosure and with reference to at least FIGS. 1A and 1B, the corrosion preventative device 100 includes a timing element or indicator 150 which is integrated into the top cover 101. The time indicator 150 is configured to visually display an operational time of the corrosion preventative device. An operational time may include, but is not limited to, the amount of time the corrosion preventative device is actively emitting protective material (described above) and/or the amount of lifetime remaining of the corrosion preventative device. When the corrosion preventative device 100 is in its sealed packaging from the manufacturer, the rust-inhibiting material within the volume of the corrosion preventative device 100 is unable to escape from the corrosion preventative device 100. When the corrosion preventative device 100 is removed from the packaging (e.g., vacuum packaging, sealed packaging, etc.), the corrosion preventative device 100 is able to emit vapor and molecules through vents (such as through vents and vent apertures 104, 108) in an operational state. In some embodiments, the time indicator 150 is a TIMESTRIP® from Timestrip LTD and described in U.S. Pat. Nos. 7,232,253 and 7,362,663, incorporated by reference herein.

As best seen in FIG. 1B, the cover 101 includes a time indicator base 152 and a well portion 154 which typically do not fully penetrate in top cover 101. The time indicator base 152 and a well portion 154 are configured to receive a time indicator 150 configured to hold a liquid or liquid pouch. The time indicator includes a body 151 and a liquid well 153. The well portion 154 is configured to receive liquid well 153, and time indicator base 152 is configured to receive body 151.

The time indicator 150 is activated by compressing the liquid well 153 whereby the increased pressure on the liquid in the liquid well 153 which causes a weak seal to rupture. The liquid flows to the time indicator body 151 which is configured as a migration medium for the liquid. An upper layer 158 includes an opening or a transparent window 160 that allows a user to view the progress of the fluid migration on the time indicator 150. The upper layer 158 can be connected to the cover 101 by an adhesive and/or mechanical connection.

As time progresses, the liquid starts to migrate from the liquid well 153 and through the time indicator body 151. The material selected for the fluid and migration medium migration medium in the time indicator body 151 determines how long the liquid takes to flow across the entire migration medium. The time period is non-limiting and may be from about one month to about five years, including any time selected in-between.

In accordance with another aspect of the present disclosure and with reference to FIG. 1C, the corrosion preventative device 100 is illustrated with a top cover 101 having an alternative arrangement of vents 104 and apertures 108 which form the vents to fully penetrate the top cover 101. That is, the vents 104 and apertures 108 are positioned primarily on the top surface 112 of the top cover 101. The vents 104 and apertures 108 are disposed in recessed, channel-like features 106 formed on one or more sides of the top cover 101.

Figure 1D:
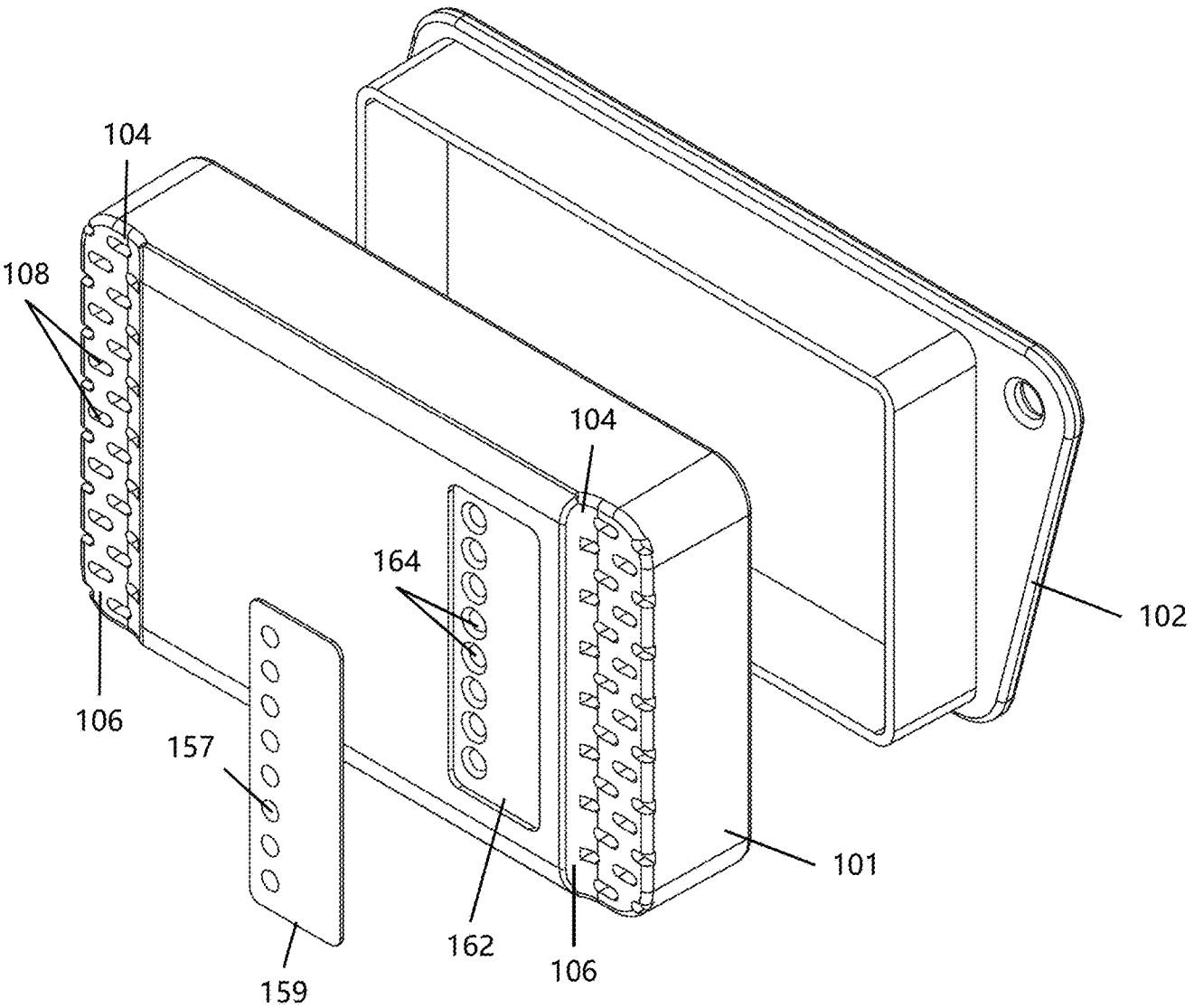

Furthermore, the corrosion preventative device 100 is also configured in FIGS. 1C and 1D with an alternative timing element or indicator 150. That is, the indicator is configured as a panel 159 which can be inserted into a corresponding recess 162 of the top cover 101. Recess 162 includes a plurality of recess cavities 164 that are further depressed in top cover 101. Recess 162 and recess cavities 164 are configured to typically not fully penetrate top cover 101.

The panel 159 is generally formed of a metal foil, paper, paper board, or a plastic film or sheet. Time information 153, 155, and 157 is located on the front face of time indicator panel 159. For example, time information 153 is in the form of numerical years (e.g., 2019, 2020, 2012, 2022), time information 155 is in the form of pictures that represent seasons (e.g., snowflake/winter, flower/spring, sun/summer, leaf/fall), and time information 157 is in the form of a deformable element such as selection circles that are positioned next to time information 153 and 155. The position of the deformable selection circles is oriented over a plurality of recess cavities 164 such that a user can deform or puncture the selection circles to indicate at least one of corresponding time information 153, 155.

For example, a user can use a pencil, pin, or other object to mark and/or puncture one or more of the selection circles. The time indicator panel 159 is used by a user to indicate when the corrosion preventative device 100 is first used. For example, if the corrosion preventative device 100 was first inserted in a storage container in the winter of 2012, then the selection circles next to 2012 and the snowflake would be punctured or otherwise marked by a user to indicate such time period. As such, time panel indicator 159 can be used by a user to determine when to replace the corrosion preventative device or the VCI protective material in the corrosion preventative device based on when the corrosion preventative device 100 was first used.

Figure 2B:
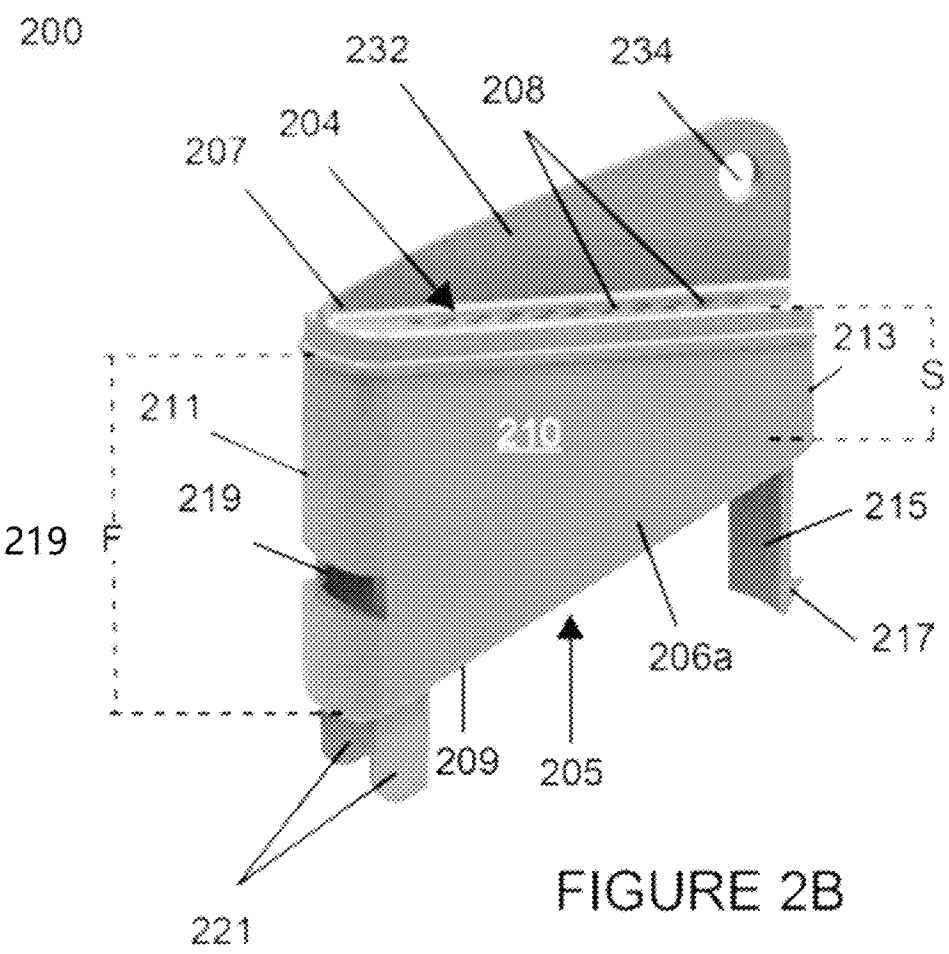
FIGS. 2A-2D are illustrations according to a non-limiting embodiment of the present disclosure, where
Figure 2A:
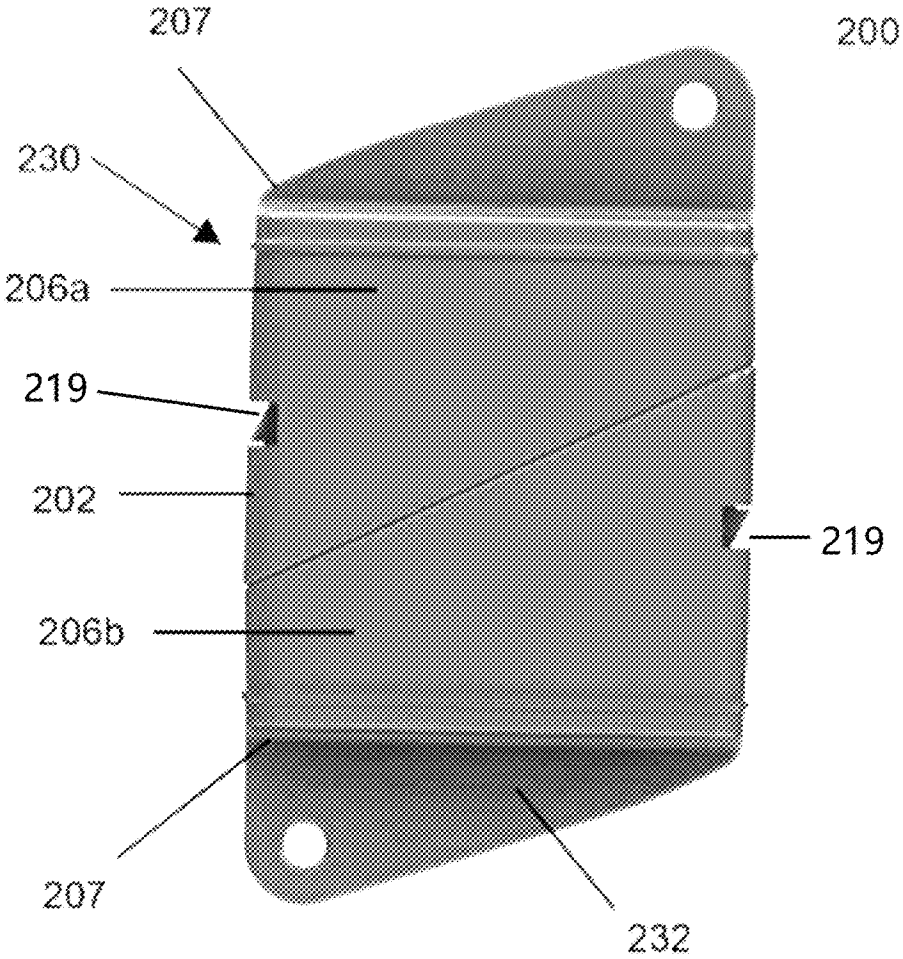

FIG. 2A illustrates an exemplary corrosion preventative device 200 in accordance with the present disclosure. The corrosion preventative device 200 includes a body 202 having a hollow interior volume 205 and vent ends 207. The hollow interior volume is configured to house a VCI protective material as described above. The corrosion preventative device body 202 also includes at least one vent 204 that allows some of the VCI protective material that is loaded in the hollow interior to escape and diffuse into the local environment. In some embodiments, and illustrated in FIGS. 2A and 2B, the at least one vent is defined by a plurality of apertures 208 present on one or both vent ends 207 of the body 202.

In some embodiments and with reference to FIGS. 2A-2B, the body 202 is formed of two substantially similar body segments, including upper body segment 206*a* and lower body segment 206*b*. The body segments 206 are formed of a front wall 210, an opposing rear wall (not shown), a first side wall 211, and opposing second side wall 213. The body segments 206 also include a vent end 207 and an opposing connection end 209. In some embodiments, the first side wall 211 has a length F that is greater than the length S of the second side wall 213. In these embodiments, the connection end 209, connected to the first and second sidewalls 211, 213 is angled with respect to the vent end 207 and is illustrated in FIG. 2B.

In some embodiments, each substantially similar body segment 206*a*, 206*b* includes a connection set for joining body segments together. In more particular embodiments, the second sidewall 213 includes a cantilever 215 and hook 217 extending out from the connection end 209. The cantilever 215 and hook 217 are configured to engage a slot 219 in a first sidewall 211 of an adjacent connecting body segment in a snap-fit relationship. In some embodiments, the first sidewall 211, further includes a pair of guide rails 221 that extend out from the connection end 209 and are configured to guide the cantilever 215 and hook 217 of a connecting body segment 206 about a connection end to the engage the slot 219. It is to be appreciated that while cantilever, hook, slot, and snap-fit connections are described herein as connection sets, other fasteners, that either permanently connect or removably connect adjacent body segments 206*a*, 206*b*, may be used.

Before two body segments 206*a*, 206*b* are joined together via fasteners and/or connection sets, the VCI protective material described above may be inserted into the interior volume 205 of one or both of body segments 206*a* and 206*b*. The VCI protective material is then enclosed in the interior 205 of the body 202 of the corrosion preventative device 200 when a second segment is attached.

Figures 2C, 2D:
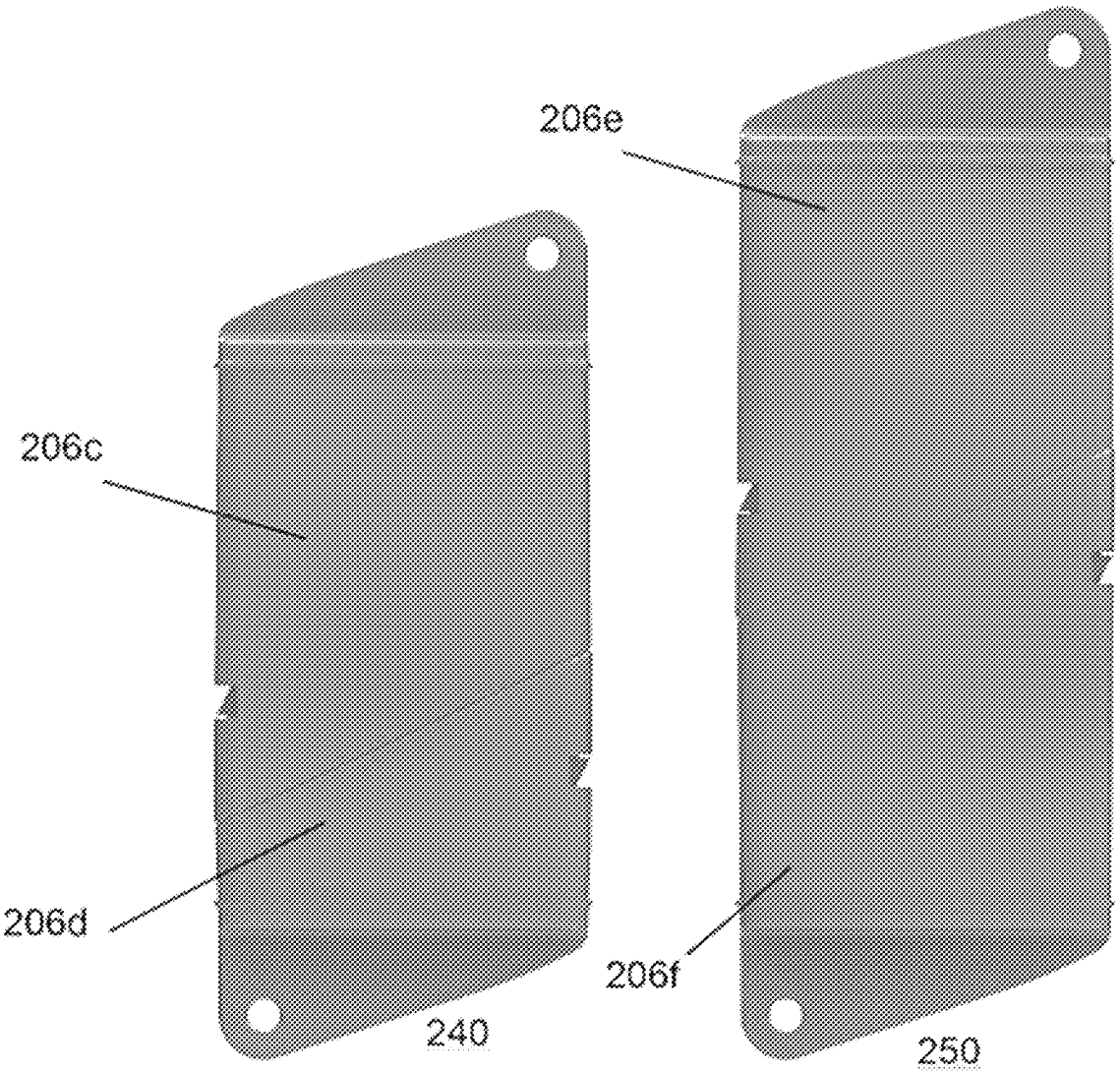

In some embodiments and with respect to FIGS. 2A, 2C, and 2D, the corrosion preventative device 200 can be configured in many different sizes. For example, and with reference to FIG. 2A, the upper and lower body segments 206*a*, 206*b* are joined to create a small corrosion preventative device 230. As another example, and with reference to FIG. 2C, an upper extended body segment 206*c* is configured with sidewalls having lengths greater than the sidewalls 211, 213 of upper body segment 206*a* in FIG. 2B. In this way, the upper and lower extended body segments 206*c*, 206*d* are joined to create a medium-sized corrosion preventative device 240. As yet another example, and with reference to FIG. 2D, upper and lower extended body segments 206*e*, 206*f* are configured with sidewalls having lengths greater than the sidewalls of body segments 206*a*, 206*b* in FIG. 2B and the sidewalls of body segments 206*c*, 206*d*. In this way, the upper and lower extended body segments 206*e*, 206*f* are joined to create a large corrosion preventative device 250. Each corrosion preventative device 230, 240, 250 is capable of housing an increasing amount of VCI protective material. For example, the small corrosion preventative device 230 may be configured to house enough VCI protective material to last two years, while the medium size corrosion preventative device 240 may contain enough VCI protective material to last 3+ years and the large corrosion preventative device 250 may be capable of holding enough VCI protective material to last for 4+ years. Although 2-4 years is discussed herein, it is to be appreciated that a corrosion preventative device may be configured to house enough protective material to last anywhere from one month to 10 years, including any amount of time therebetween.

In some embodiments and with reference to FIGS. 2A-2B and 3A-3B, the corrosion preventative device 200 includes a fin section 232 extending out from the vent end 207 of each segment 206. The fin 232 is an outward projection of material that may be molded with the segment 206. The fin 232 provides a structure that a user may grasp and hold the corrosion preventative device 200. The fin 232 may also facilitate the mounting of the corrosion preventative device 200 in a storage container described in greater detail below. In some embodiments, the fin 232 further includes a fin hole 234 configured to facilitate mounting. In some embodiments, the fin hole 232 is configured to accommodate a fastener that is able to secure the corrosion preventative device 200 to a wall or portion of an associated storage container.

Figure 3A:
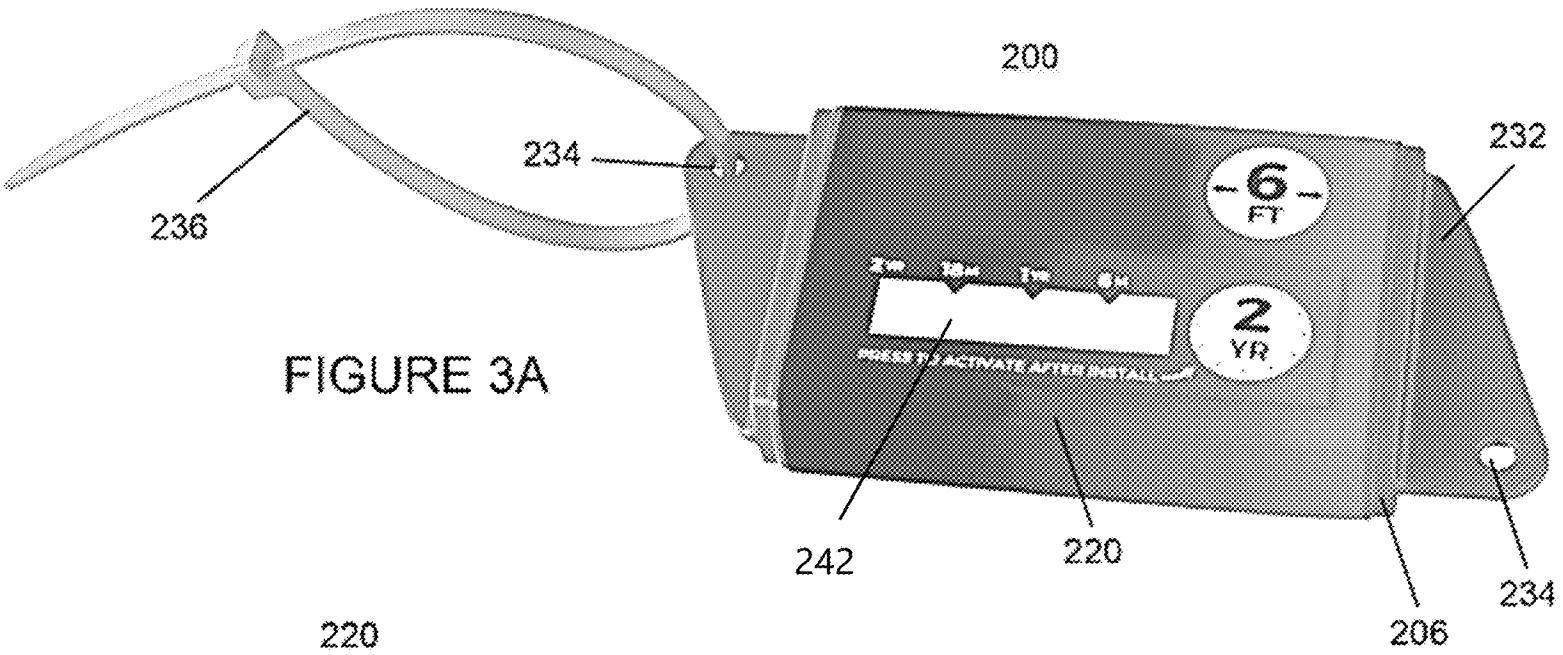
FIGS. 3A-3B and 4A-4B are illustration according to one non-limiting embodiment of the present disclosure, where
Figure 3B:
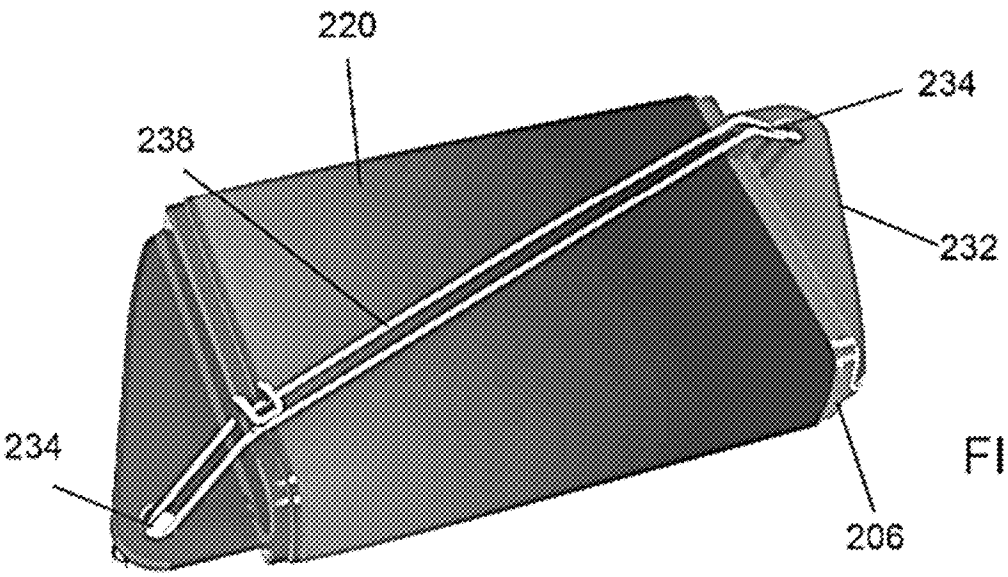

In some embodiments and with particular reference to FIGS. 3A and 3B, the corrosion preventative device 200 includes one or more tethering or attachment mechanisms for mounting the corrosion preventative device in a desired location. In some embodiments and with particular reference to FIG. 3A, the fin hole 234 is configured to receive a tie, such as a zip tie 236. The zip tie 236 may be used to tether the corrosion preventative device 200 to an interior of a storage case. In some embodiments and with particular reference to FIG. 3B, a set of fin holes 234 are configured to hold a safety pin 238 diagonally across the body 202 as the fin holes 234 are located in opposite corners of the corrosion preventative device 200. The safety pin 238 allows the corrosion preventative device 200 to attach to a sewn case or duffle bag wherein metallic articles may be stored. Additionally, it is noted that the body 206 of the corrosion preventative devices illustrated in FIGS. 3A and 3B includes a plastic or paper wrap 220 featuring a design or other functional features which is placed over the body.

As illustrated in FIGS. 3A and 3B, the plastic or paper wrap 220 includes a distance reference number 246 which indicates a perimeter of protection provided by the corrosion preventative device 200 (e.g., 6 ft., etc.). Also located on the plastic or paper wrap 220 is information on the life of the corrosion preventative device 200 (e.g., 2 yrs., etc.). The front face includes a time indicator 242 similar to that described above with reference to FIGS. 1A-1B. As illustrated in FIG. 3A, the front face includes an indicator 244 where a user can activate the time indicator 242. The time indicator 242 is configured to provide information about the life of the corrosion preventative device 200 (e.g., 2-year life period, etc.). The time indicator 242 can be integrated in the body of the corrosion preventative device 200 or be part of the plastic or paper wrap 220. Typically, the time indicator 242 in integrated in the body of the corrosion preventative device 200 or connected to the front face of the corrosion preventative device 200 and the plastic or paper wrap 220 is positioned partially or fully over the time indicator 242.

Figure 4B:
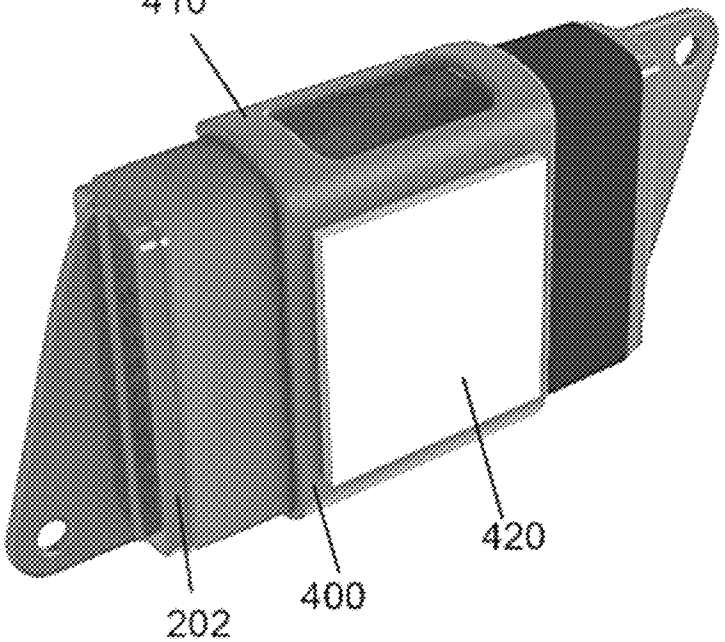
Figure 4A:
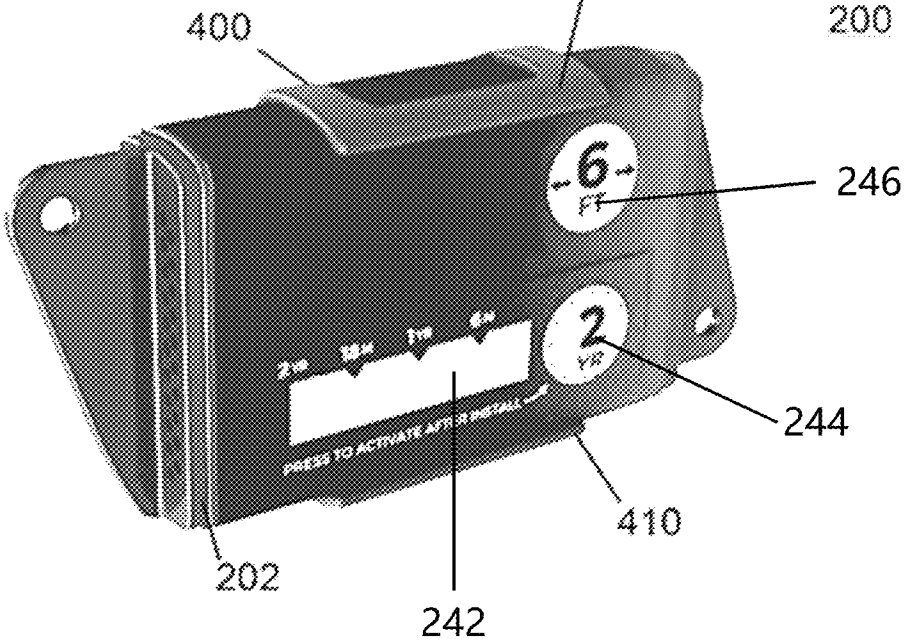

In some embodiments and with reference to FIGS. 4A and 4B, the corrosion preventative device 200 is configured to removably engage a mount clip 400. The mount clip 400 includes flexible projections 410 that provide a snap-fit engagement with the corrosion preventative device body 202. In some embodiments, the projections 410 have a cross section that is an arc. The projections 410 are configured flex out when a user applies a pushing force to a corrosion preventative device 200 to engage the mount clip 400. Upon application of a sufficient amount of force, the corrosion preventative device 200 will move to the inside bounds of the projections wherein the projections 410 will flex back to their original position. In the original position, the curvature of the projections 410 allows a portion of the projection 410 to wrap around the corrosion preventative device body 202 and secure it to mount clip 400 by urging the body to contact the mount clip 400. The clip 400 my mount to the inside of a storage container via an adhesive 420 (or other attachment means, e.g., magnets for metallic storage containers). In this way, a user may replace the corrosion preventative device 200 within the storage container with another corrosion preventative device and retain the same mounting equipment. While curved projections 410 are described herein, it is to be appreciated that other structures for removably attaching the corrosion preventative device body 202 to the mount clip 400 may be used.

Figure 5A:
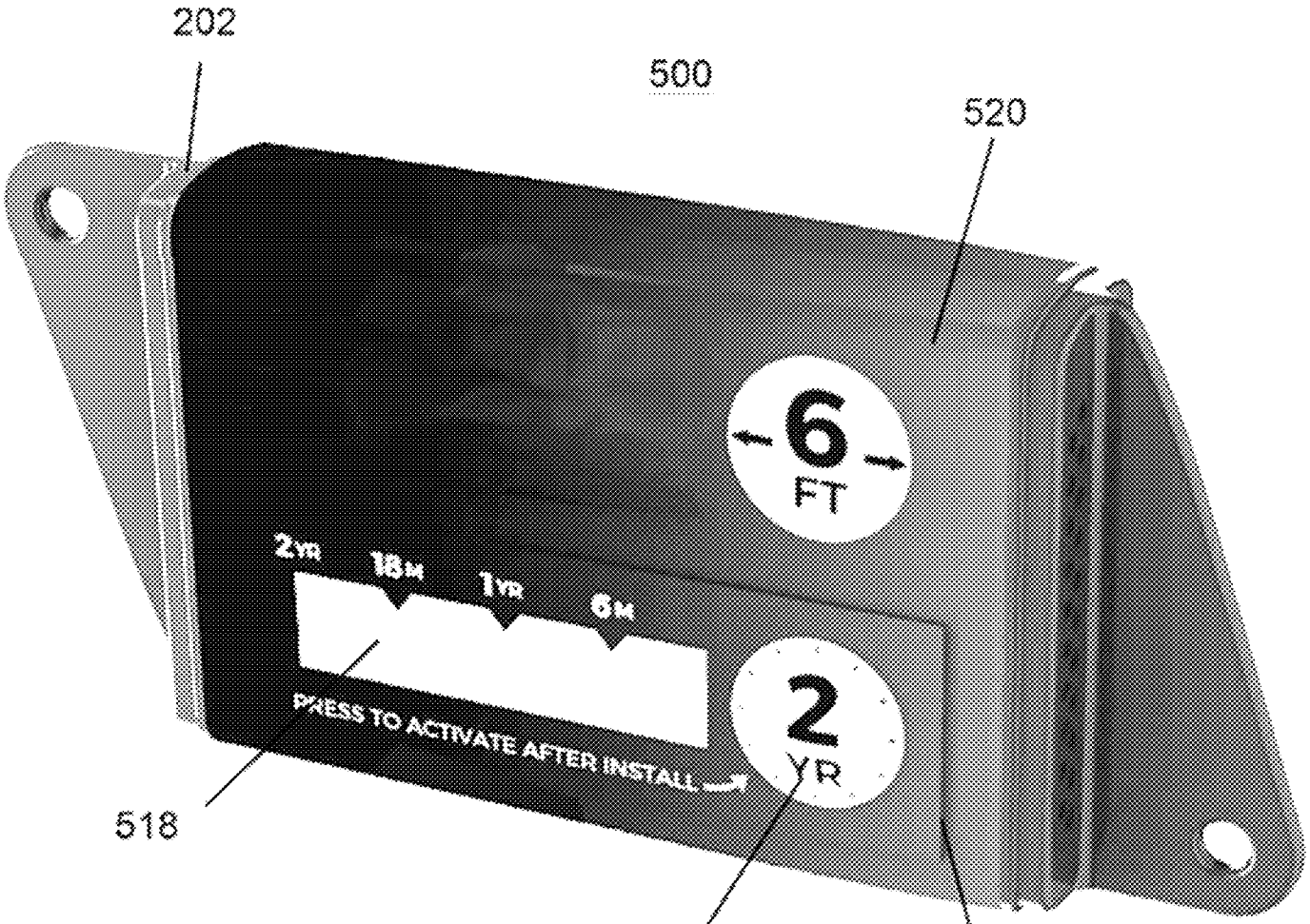
FIGS. 5A-5D are illustrations according to one non-limiting embodiment of the present disclosure, where
Figure 5D:
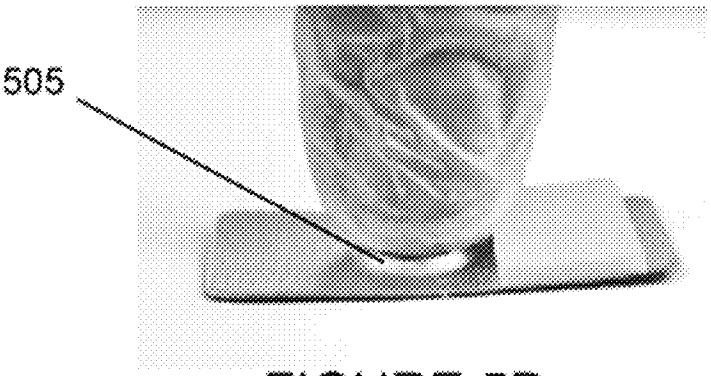
Figure 5C:
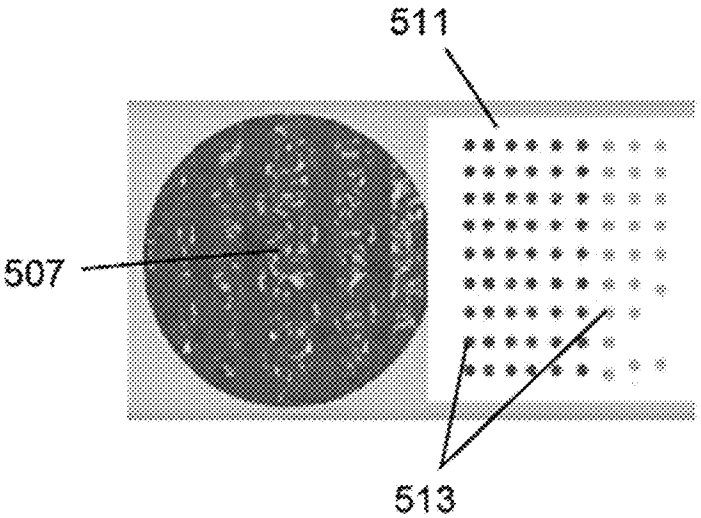
Figure 5B:
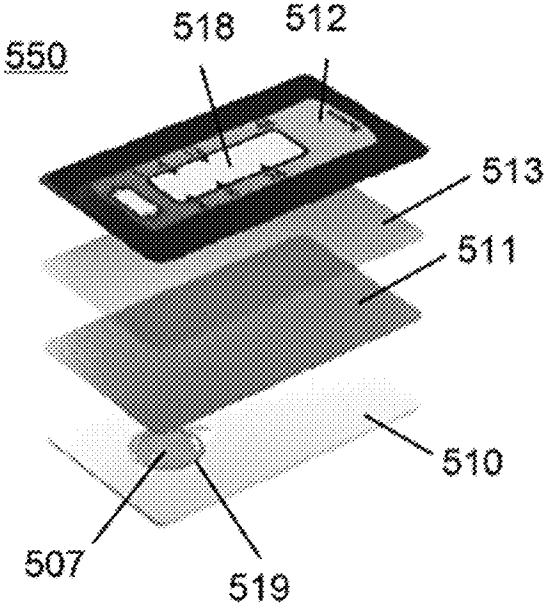

In accordance with another aspect of the present disclosure and with reference to FIGS. 5A-5D, a corrosion preventative device 500 further includes a timing element or indicator 550. As illustrated in FIG. 5A, the time indicator 550 is a separate device that may be adhered to the packaging 520 (wrap) of the corrosion preventative device 500. That is, a plastic or paper wrap featuring a design may be placed over the body 202 and the time indicator 550 may adhere to said packaging 520. Additional features of the time indicator 550 can be seen with reference to FIGS. 5B-5D, and it is noted that the time indicator 550 is substantially similar to time indicator 150 described above with reference to FIGS. 1A-1B. The time indicator 550 includes base layer 510 with a dish portion 519 that forms a button 505 and which houses a liquid 507. The time indicator 550 is activated by compressing the dished portion 519 via button 505 whereby the increased pressure on the liquid 507 in the reservoir which causes a weak seal to rupture. The liquid 507 flows to a middle layer 511 that comprises a porous 513 or micro-porous medium which act as the migration medium, wherein the liquid 507 begins its slow migration along said medium. An upper layer 512 includes a transparent window 518 that shows the progress of the fluid migration. As time progresses, the liquid 507 starts to migrate out from the dish portion 519 and begins to color migration medium lengthwise. The selection of fluid 507 and migration medium 511 determines the time period for which the liquid 507 flows across the entire time indicator 550. The time period is non-limiting and may be from about one month to about five years and any time selected in-between.

Figure 6B:
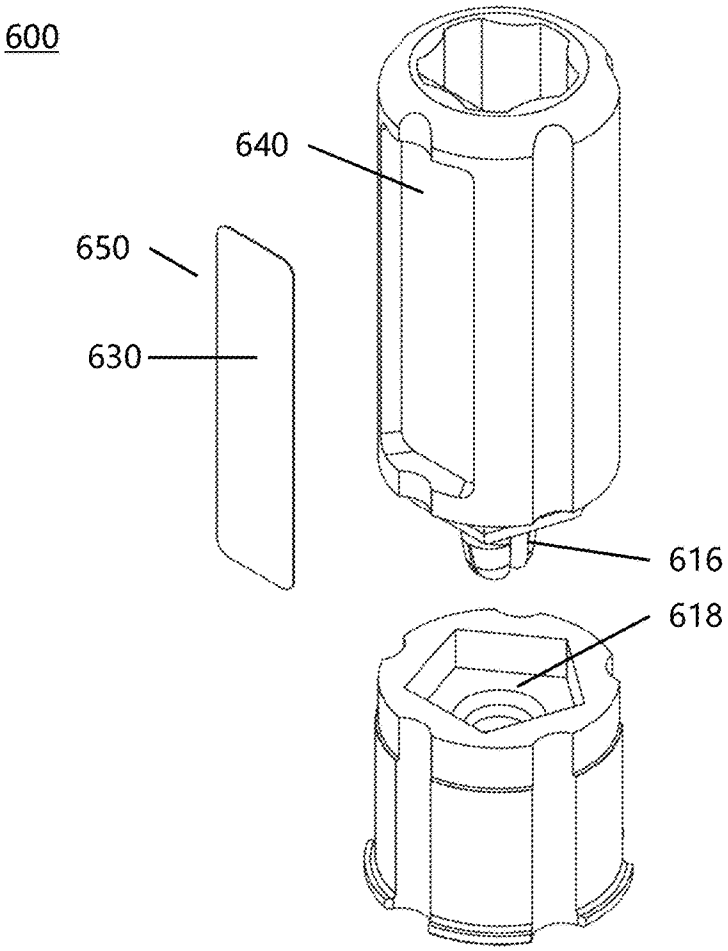
FIGS. 6A-6C are illustrations according to a non-limiting embodiment of the present disclosure, where
Figure 6A:
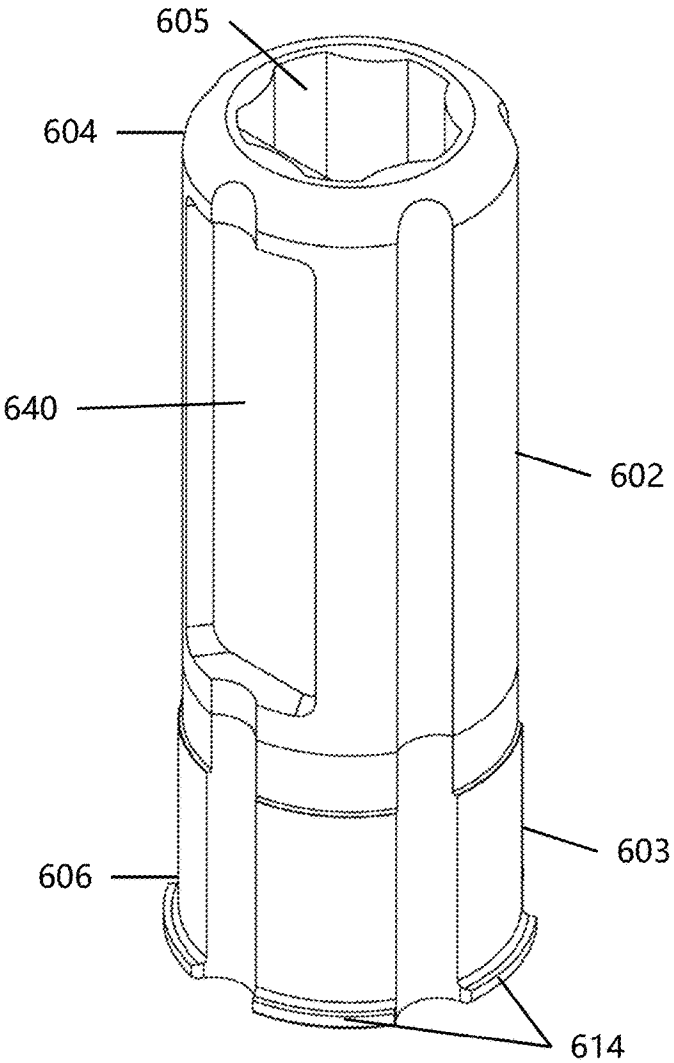
Figure 6C:
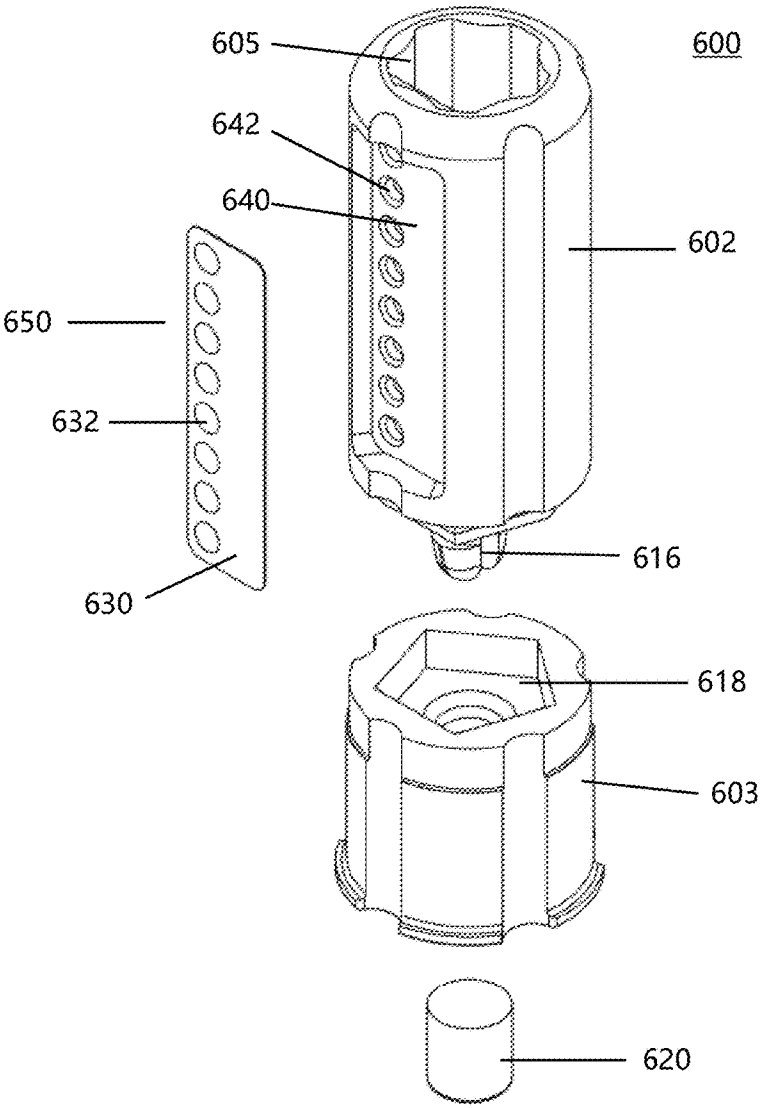

In other embodiments and illustrated in FIGS. 6A-6C, a corrosion preventative device 600 further includes a snap cap body that is formed of an upper body 602 and a base 603. The upper body 602 extends from the top of the base 603 to define a first end 604 of the snap cap corrosion preventative device 600. The first end 604 is generally configured to be inserted within the barrel, magazine, chamber, etc., of an associated firearm (not shown). The second end 606 of the corrosion preventative device 600 is disposed adjacent the base 603 and includes one or more material protrusions, such as one or more flanges 614 which are disposed at least partially around the exterior perimeter of the base. The one or more flanges 614 are generally configured to maintain the position of the snap cap corrosion preventative device 600 within the associated firearm in which the capsule is disposed.

In one non-limiting configuration, the VCI protective material 620 can be placed in the hollow interior region 605 by inserting the VCI protective material 620 into the opening on the first end 604 to retain the protective material. Alternatively, the VCI protective material 620 can be inserted into a cavity in the base 603 as illustrated in FIG. 6C. The VCI protective material 620 can be in the form of a powder, plug, pellets, etc. In one non-limiting arrangement, the VCI protective material 620 is part of a porous matrix material the forms a plug that allows the VCI protective material to flow from the porous matrix material and disperse about the exterior surface of the snap cap corrosion preventative device 600. As can be appreciated, other or additional arrangements can be used to enable the release of the VCI protective material 620 from the corrosion preventative device 600. For example, one or more vents comprised of a plurality of apertures (not shown) can be provided on the upper body 602 or base 603.

The base 603 is configured to receive and connect to upper body 602. In some non-limiting embodiments, the upper body 602 is permanently attached to the base 603. For example, the upper body 602 can be over-molded on the base 603 to permanently secure the upper body 602 to the base 603. One non-limiting example of a connection arrangement can be seen in FIG. 6B, where clip 616 is positioned on the bottom of the upper body 602 and is configured to engage with a corresponding mating recess 618 formed on the top of the base 603 to secure the upper body to the base. In other embodiments, the upper body 602 can be removably attached to the base 603 and the position containing the VCI protective material 620 can be replaced after losing some or all of its corrosion protection properties. Alternatively, a new plug of VCI protective material 620 can be inserted into the upper body 602 or base 603 when a former plug of VCI protective material 620 has been spent or expired.

Moreover, snap cap corrosion preventative device 600 includes a time element or indicator 650 which is integrated with the upper body 602. However, this configuration is non-limiting and the time indicator 650 could alternatively be configured as a separate device which is adhered to at least some portion of the corrosion preventative device 600, such as the packaging wrap (not shown). In one exemplary arrangement, the upper body 602 of the snap cap corrosion preventative device 600 includes a recessed portion 640, the size and shape of which is non-limiting, and the panel 630 of the time indicator 650 can be inserted into the recessed portion 640. The recessed portion 640 can include one or more cavities 642.

In one non-limiting embodiment, it is noted that the time indicator 650 can operate in a substantially similar manner as time indicators 150 and 550 described above with reference to FIGS. 1A-1B. As such, panel 630 is generally formed of a metal foil, paper, paper board, or a plastic film or sheet. Time information can be located on the front face of time indicator panel 630. For example, time information in the form of numerical years (e.g., 2019, 2020, 2012, 2022), time information is in the form of pictures that represent seasons (e.g., snowflake/winter, flower/spring, sun/summer, leaf/fall), and time information is in the form of a deformable element such as selection circles 632 that are positioned next to time information. The position of the deformable selection circles 632 is oriented over a plurality of recess cavities 642 such that a user can deform or puncture the selection circles to indicate at least one of corresponding time information. Alternatively, in another non-limiting embodiment, it is noted that the time indicator 650 can operate in a substantially similar manner as time indicator 150 described above with reference to FIGS. 1A-1B and FIGS. 5A-5D. As such, time indicator 650 can be used by a user to determine when to replace the snap cap corrosion preventative device 600 or the VCI protective material 520 housed therein.

Figure 7A:
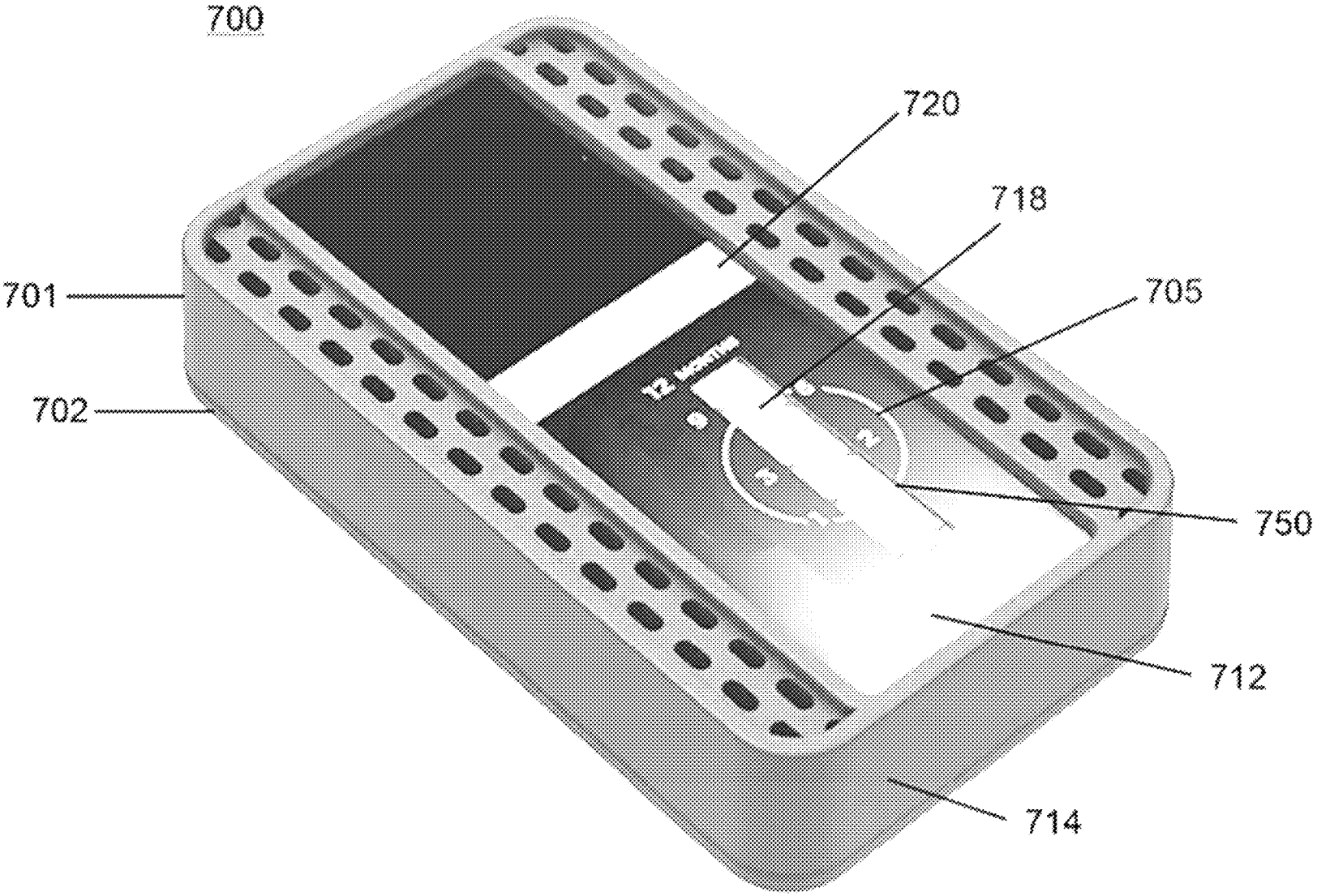
FIGS. 7A-7C are illustrations according to a non-limiting embodiment of the present disclosure, where
Figure 7B:
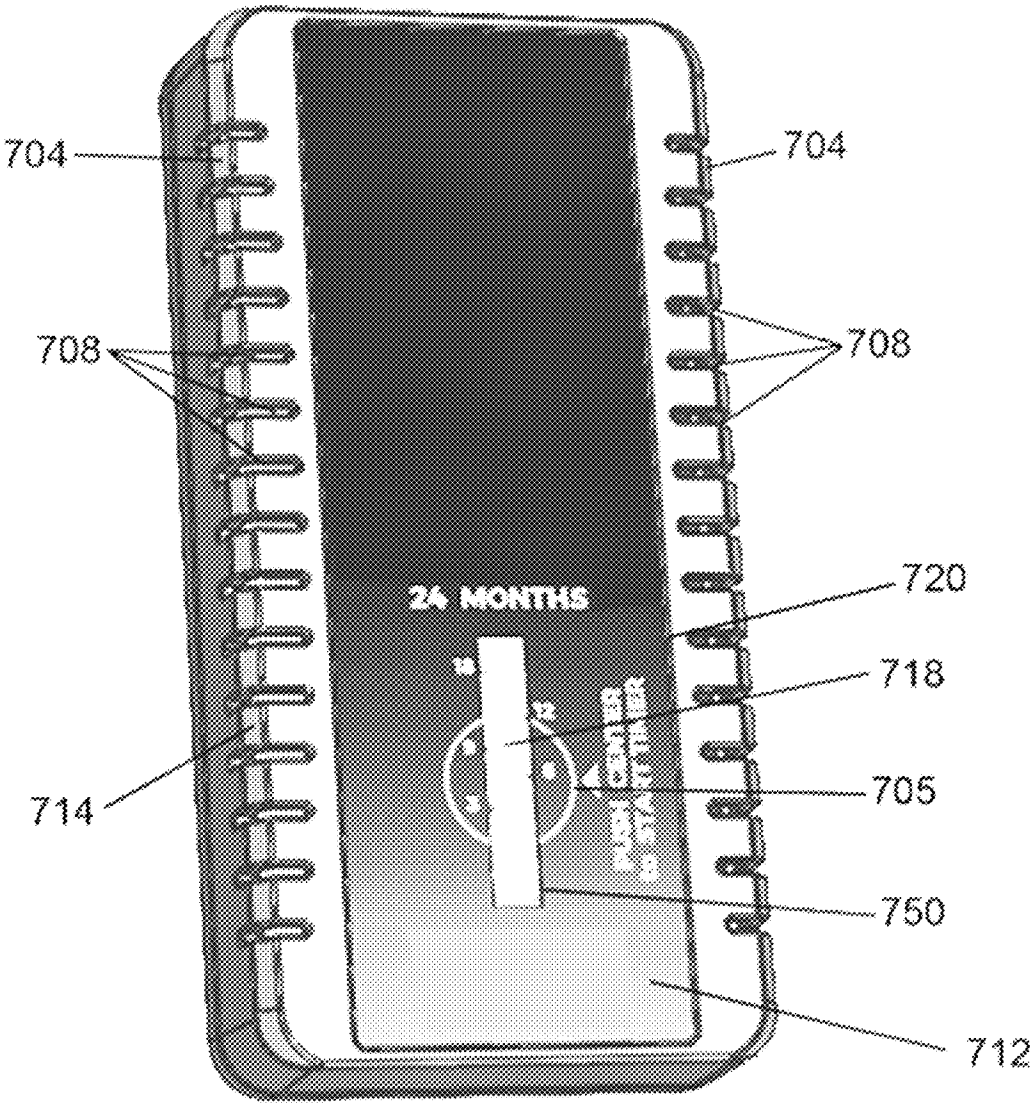
Figure 7C:
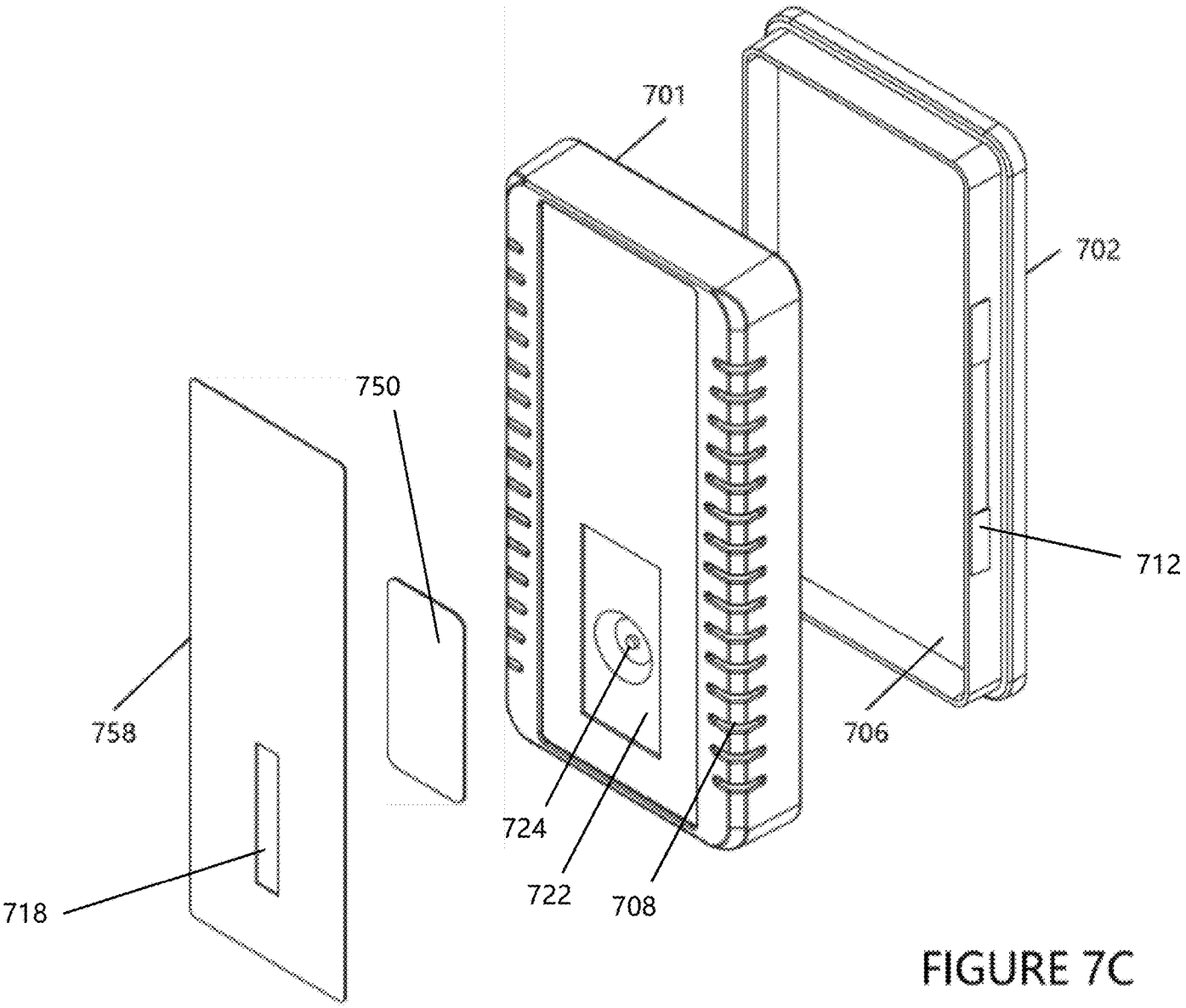

In other embodiments and illustrated in FIGS. 7A-7C, the body of a corrosion preventative device 700 includes a base 702 and top cover 701. The top cover 701 and base 702 are substantially similar to top cover 101 and base 102 described above with reference to FIGS. 1A-1B. Thus, the top cover 701 may snap connect to base 702 and define a cavity 706 therein. The cavity 706 is configured to house a VCI protective material as described above. One or more vents 704 defined by a plurality of apertures 708 are disposed in the cover 701 and allow for vapor and molecules of the VCI protective material to be released from the interior cavity 706 of the corrosion preventative device 700. The position of the vents 704 and apertures 708 is non-limiting and they may be positioned on the top surface 712 of the corrosion preventative device as illustrated in FIG. 7A, on a sidewall 714, or a combination of locations. As illustrated in FIGS. 7B and 7C, for example, the vents 704 and apertures 708 are positioned on both the top surface 712 and sidewall 714. The top cover 701 and base 702 can be connected together by use of clips or snap arrangements 712; however, other arrangements can be used (e.g., adhesive, etc.).

Moreover, corrosion preventative device 700 includes a timing element or indicator 750 which is integrated with the top cover 701 and includes product packaging 720. The top surface of the top cover 701 can include a recess portion 722 to receiving a portion of all of the timing element or indicator 750. As illustrated in FIG. 7C, the recess portion 722 can include a puncture flange 724 that extends upwardly from the recess portion 722 and is used to puncture the timing element or indicator 750 to cause the timing element or indicator 750 to be activated when the button 705 is depressed by a user.

It is noted that the time indicator 750 operates in a substantially similar manner as time indicators 150 and 550 described above with reference to FIGS. 1A-1B and 5A-5D. Corrosion preventative device 700 includes product packaging 720 comprised of a piece of film which adheres to the top cover 701 and covers the time indicator 750 and its associated components until the capsule is ready for use. In some embodiments, the packaging 720 can include the button 705 and window 718. In other embodiments, the button 705 and window 718 can be included with the upper layer 758 of the time indicator 750 and is covered by the product packaging 720. The packaging can be a releasable film that, once removed, activates the corrosion preventative device 700.

Figure 8A:
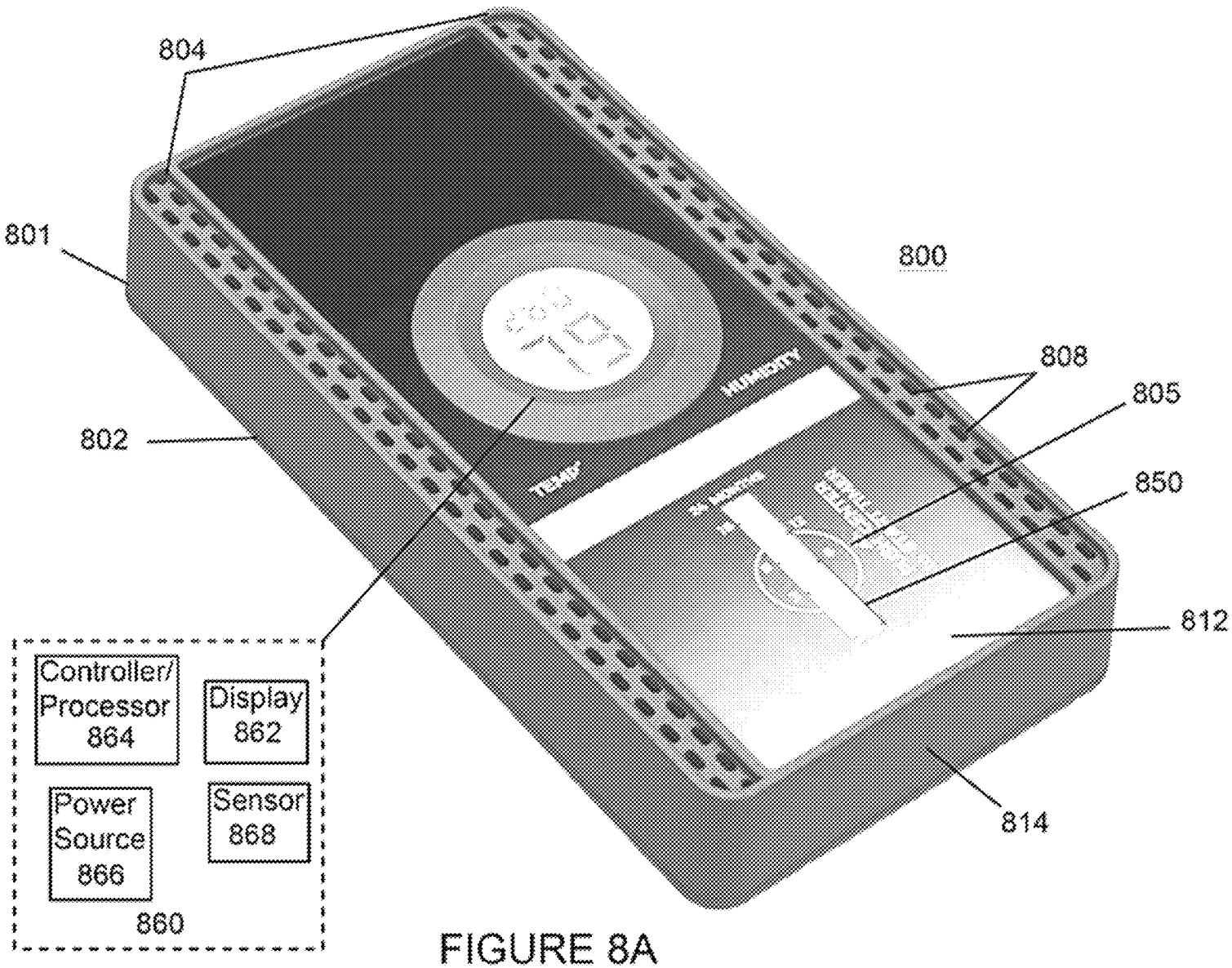
Figure 8C:
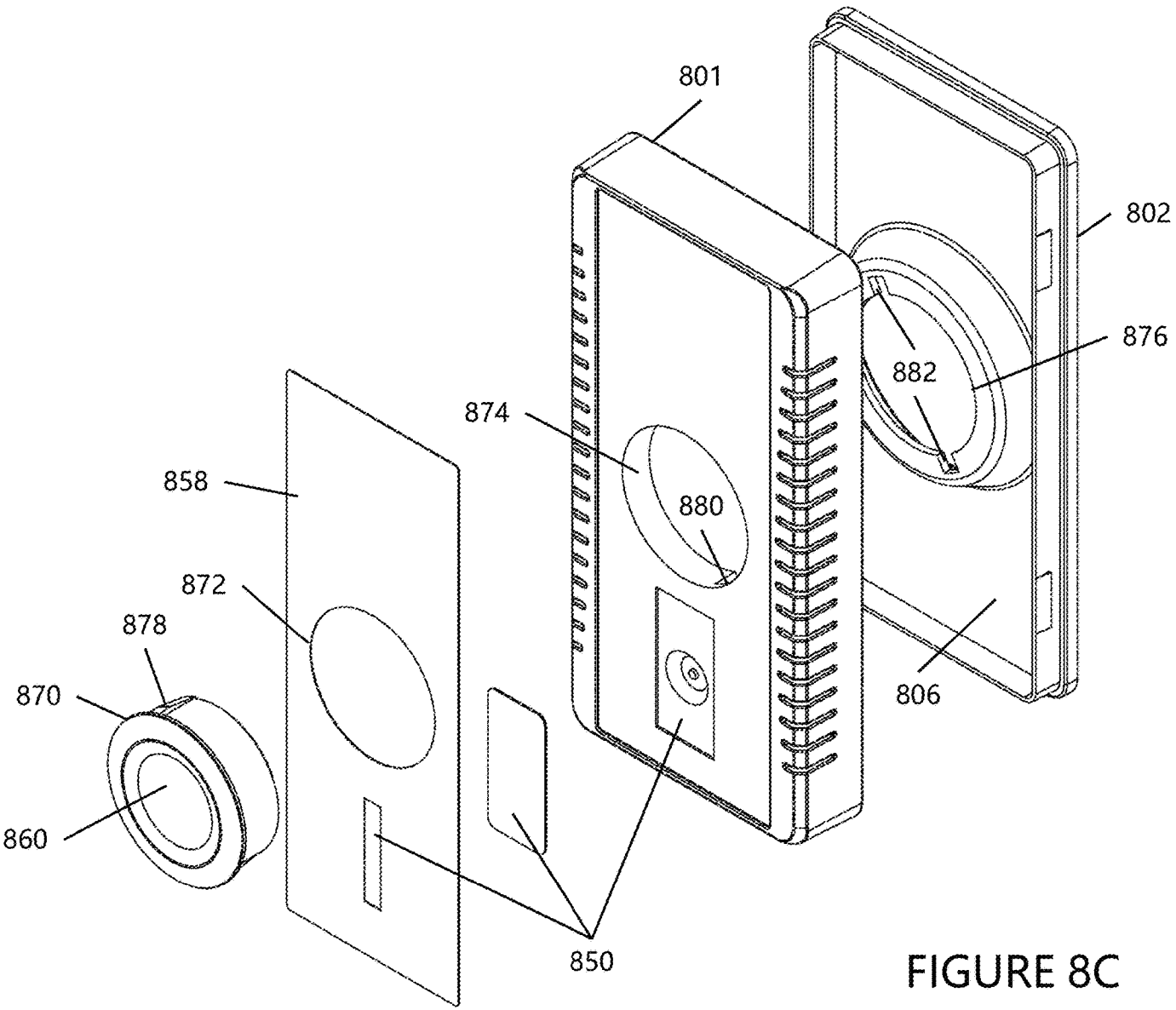

In some embodiments and with reference to FIGS. 8A-8C, the body of a corrosion preventative device 800 includes a base 802 and top cover 801. The top cover 801 may snap connect to base 802 and define a cavity 806 therein; however, other connection arrangements can be used. The cavity 806 is configured to house a VCI protective material as described above. One or more vents 804 defined by a plurality of apertures 808 are disposed in the cover 801 and allow for vapor and molecules of the VCI protective material to be released from the interior cavity of the corrosion preventative device 800. The position of the vents 804 and apertures 808 is non-limiting and may be positioned on the top surface 812 of the corrosion preventative device as illustrated in FIG. 8A, on a sidewall 814, or a combination of locations. As illustrated in FIGS. 8B and 8C, for example, the vents 804 and apertures 808 are positioned on both the top surface 812 and sidewall 814. The corrosion preventative device 800 may also include a timing element or indicator 850 similarly configured as described above with regard to FIGS. 1A-1D and FIGS. 5A-5D.

In some embodiments and with continued reference to FIGS. 8A and 8B, the corrosion preventative device 800 further includes a digital display system 860. The digital display system 860 includes a display 862 in electronic connection with an electronic controller 864, (e.g., a processor) and power source 866 (e.g., a battery). The display system 860 is configured to display information regarding the status of the corrosion preventative device 800 or the surrounding environment. In some embodiments, the display system 860 is configured to display the amount of time that the corrosion preventative device 800 has been in use. A user may depress a button, such as button 805, that begins a time counting sequence calculated by the device controller 864. The amount of time that has passed since depressing the time button 850 may be displayed on display 862. In other embodiments, the display 862 may indicate the remaining life of the corrosion preventative device 800, indicate whether the device (and VCI protective material contained therein) has expired, humidity, temperature, the amount of VCI particles (measured in parts per million [ppm]) present in the air, etc.

In accordance with another aspect of the present disclosure and with continued reference to FIGS. 8A-8C, the corrosion preventative device 800 further includes at least one sensor 868 in electronic communication with the device controller 864 and display system 860. The at least one sensor 868 is configured to measure one or more environmental conditions. Environmental conditions include, but are not limited to, temperature, humidity, the amount of VCI particles (measured in parts per million [ppm]) present in the air, composition of ambient environment (e.g., composition of air about the corrosion preventative device 800, etc.), pressure, etc. Sensors 868 include but are not limited to thermocouples, thermistors, resistance temperature detectors, humidity sensors, gas detectors, pressure sensors, semiconductor-based sensors, and the like, generally known in the art. When the corrosion preventative device 800 is placed in a sealed environment, such as a gun case, vault, storage container, or other type of receptacle, the sensors measure the environmental conditions of the sealed environment and the display presents the measured conditions to a user via display 862.

In accordance with another aspect of the present disclosure and with continued reference to FIGS. 8A-8C, digital display system 860 can be configured as an insertable module 870 which is received in designated mounting locations 872, 874, and 876. Designated mounting locations 872, 874, and 876 are formed in the upper layer 858, top cover 801, and base 802, respectively, and are sized to ensure a secure fit with the module 870. The module 870 also includes one or more retaining features 878 configured to securely engage with corresponding mounting features 880 and 882 formed in the mounting locations 874, 876 of the top cover 801 and base 802, respectively. It is to be appreciated that while, hook, slot, snap-fit connections are described herein as connection sets, other fasteners, that either permanently connect or removably connect components such as module 870, can be used.

Figure 9:
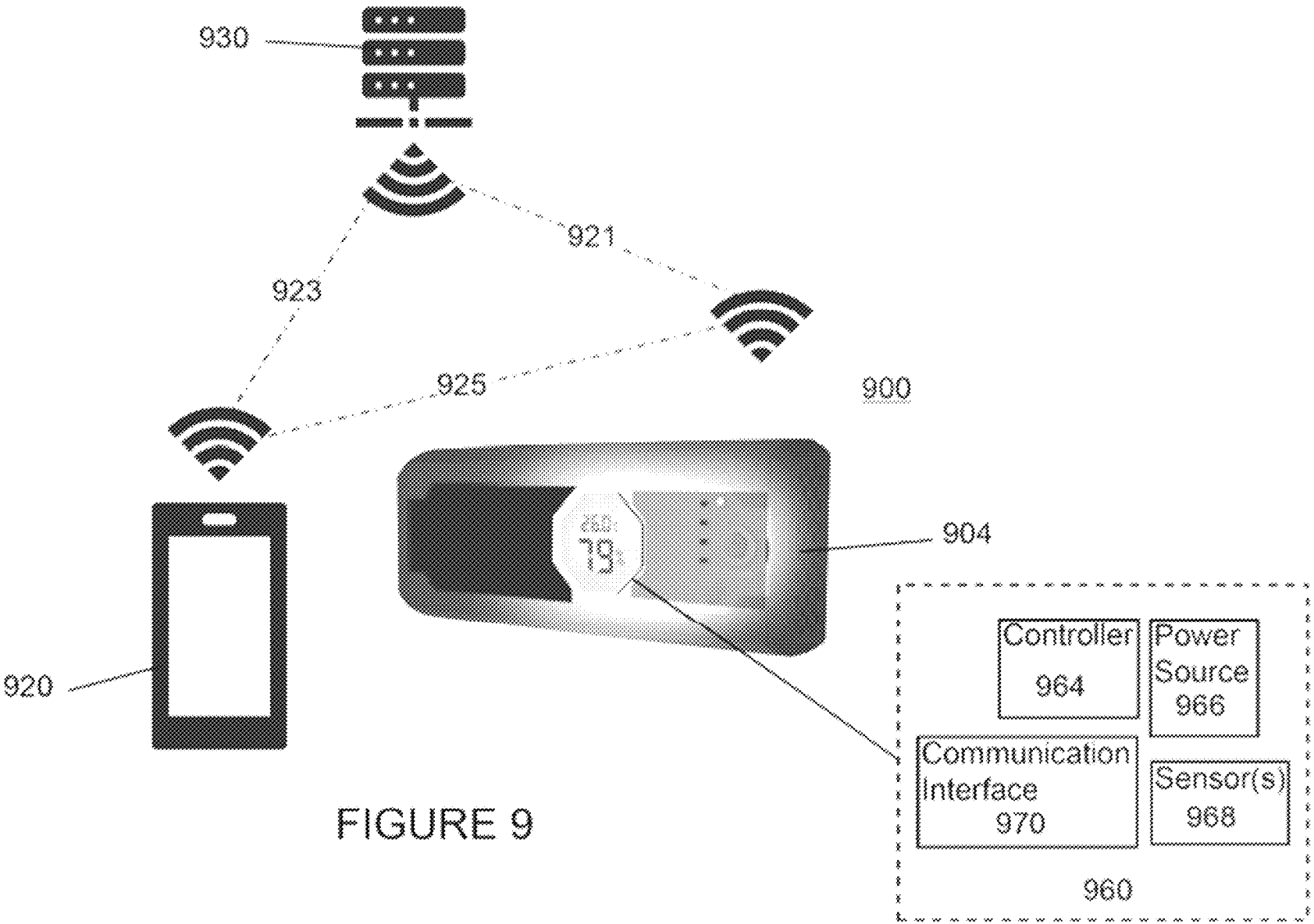
FIG. 9 is an illustration according to one non-limiting embodiment of the present disclosure, where
Figure 10:
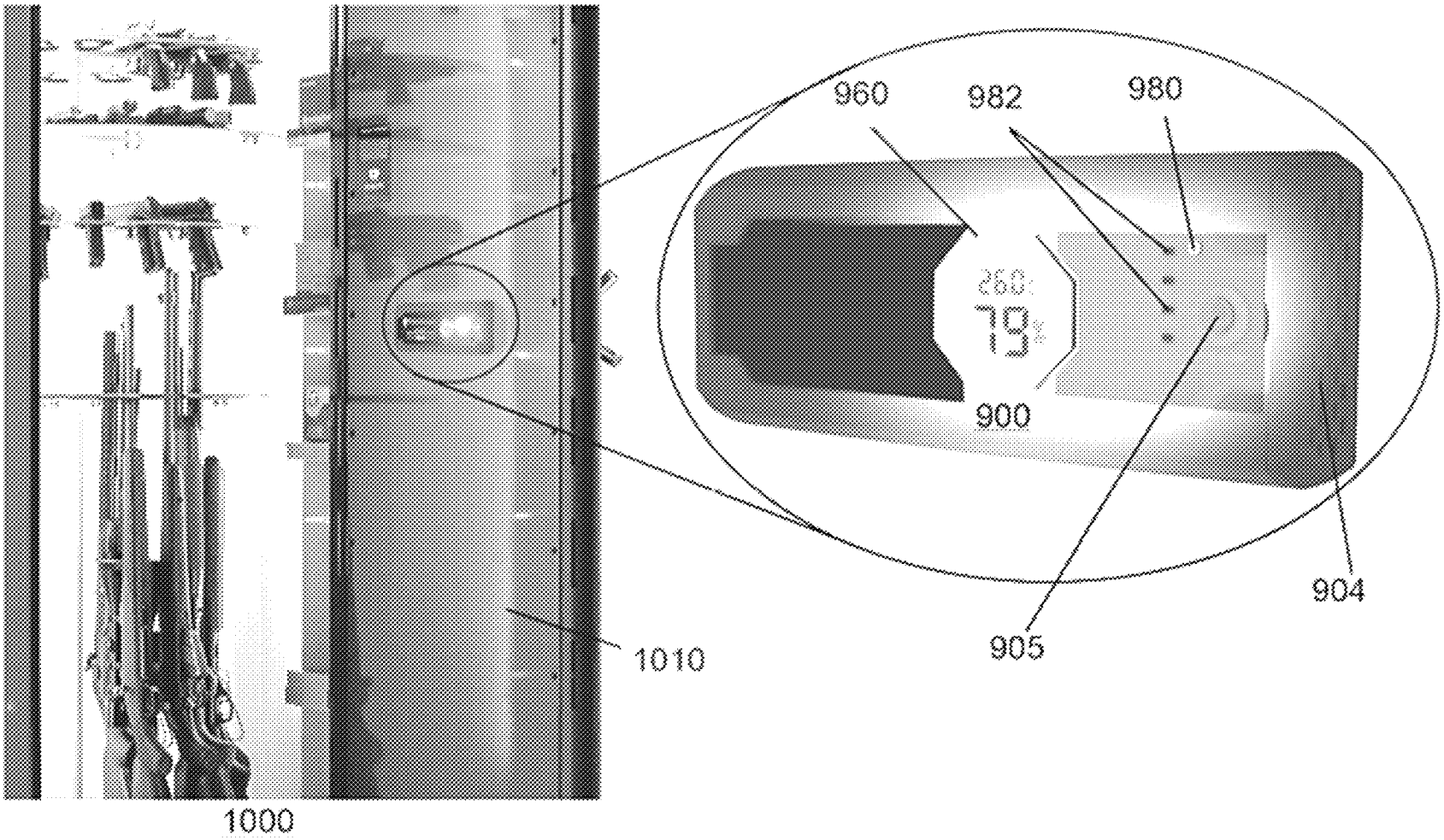
FIG. 10 shows a corrosion preventative device installed in a storage container such as a gun safe.

In accordance with another aspect of the present disclosure and with reference to FIGS. 9-10, a corrosion preventative device 900 includes various hardware components including, but not limited to, a control circuitry 964, power source 966, at least one sensor 968, and a communication interface 970, wherein the at least one sensor 968 and communication interface 970 are in electronic communication with the control circuitry 964.

The communication interface 970 includes circuitry for transmitting data via known methods including, but not limited to, RF transmission, cellular transmission, satellite transmission, etc. In some embodiments, the communication interface 970 may also receive data transmitted from a server or remote user device. In some embodiments, application software is executed by the control circuitry 964 for communicating the data to the communication interface 970 from where it is transmitted to a server 930 via a communications infrastructure having one or more communications networks such as a cellular network, satellite network, Internet, Ethernet, intranet, local area network (LAN), wide area network (WAN), etc., operating according to one or more communications protocols, such as CDMA, TDMA, 3G, Internet protocol, Bluetooth®, etc.

In some embodiments, the communication interface 970 is configured to send and receive data and signals to and from a data server 930 (connection 921). In some embodiments, the communication interface 970 is directly coupled to a LAN. In other embodiments, the communication interface 970 is in wireless communication with a WAN, such as for example and without limitation, the Internet. The communication via the WAN may be facilitated by a satellite network. In these embodiments, the server 930 is configured to receive the data transmitted from the communication interface 970 via a connection to the WAN.

The communication interface 970 transmits data generated by the at least one sensor 968. The communication interface 970 may also transmit other data including identification information, a GPS location of the corrosion preventative device 900, the date and time of transmission of the measured data, etc. The GPS identification data may be particularly useful when the corrosion preventative device 900 is deployed within a mobile storage container (e.g., duffel bag) and if the duffel bag containing the metallic article (e.g., gun) is lost or misplaced.

In some embodiments, the communication interface 970 is a plug-and-play type card or other type of memory card having an associated interface processor and interface memory. The processor of communication interface 970 may execute preprogramed application software stored within the interface memory for receiving measured data and communicating such data to a data server 930 via one or more communications networks. The communication interface 970 may include additional known hardware, for example, an antenna, RF transmission means, modem, telephone connectors, Ethernet connectors, broadband connections, DSL connections, etc., for transmitting the position and other data.

The data server 930 may be a personal computer or other known device that hosts a software platform. The software platform may be an Internet of Things (IoT) platform that is available off the shelf, modified, or designed in-house. The data server 930 may include at least one user interface or display configured to present measured data of at least one corrosion preventative device 900 to a user. It will be appreciated that the server 930 may be connected to a LAN and include any hardware, software, or combinations thereof, capable of implementing the systems and methods described herein. Suitable examples of such hardware include, for example and without limitation, processors, hard disk drives, volatile and non-volatile memory, a system bus, user interface components, display components, and the like. It will further be appreciated that multiple such devices may be used as the server 930 in accordance with the subject disclosure.

In some embodiments, the server 930 is configured to wirelessly communicate with at least one remote device 920 (connection 923). The at least one remote device 920 may be a smartphone, tablet, or other portable user interface device. The remote device 920 is configured to receive and present the measured data obtained by at least one sensor 968 and other data of the corrosion preventative device 900. Additionally, the remote device 920 may provide alerts to a user upon receiving data related to environmental conditions or time passage. That is, a remote device 920 may issue an alert when the corrosion preventative device 900 detects a certain temperature from a predefined rage. This may be particularly useful when the corrosion preventative device system 900 is associated with a door of a sealed storage container (e.g., gun vault) discussed below with regard to FIG. 10. Briefly, for security and other purposes, the measured values of certain environmental conditions may indicate that the associated door is open.

In some embodiments, the communication interface 970 includes a short link radio module (e.g. a Bluetooth® module) for exchanging data over short distances (using short-wavelength UHF radio waves). The Bluetooth® communication interface may detect the presence of other devices similarly equipped with a Bluetooth® module. That is, the Bluetooth® module may receive and process signals from a mobile communication device (such as user device 920) within a short distance from the communication interface 970. In some embodiments, when a user device 920 is within a communication range of the communication interface 970, the communication interface 970 automatically connects (connection 925) to the user device 920. In some embodiments, the communication range is from about 1 foot to about 100 feet. In more particular embodiments, the communication range is less than about 35 feet. In even more particular embodiments, the communication range is about 10 feet. The user device 920 may be equipped with a software application such that when short-link communications are established, e.g. when the user interface is within the communication range, the user device may download environmental conditions, lifetime status, or other data provided by the corrosion preventative device 900.

FIG. 10 illustrates the corrosion preventative device 900 of FIG. 9 magnetically secured to a gun vault door 1010. The corrosion preventative device 900 includes vents 904 located on sidewall ends of a top cover. The top cover is secured to a base defining a cavity therein, the cavity configured to house a supply of VCI protective material as described above. In some embodiments, the corrosion preventative device 900 further includes a photosensor 980 in electronic communication with device controller 964. The photosensor 980 is configured to detect the presence of light. When the vault door 1010 of vault 1000 is closed, the environment inside the vault 1000 will be dark. When the door is opened, light from the surrounding environment may impinge on the photosensor 980. The photosensor 980 communicates with the control circuitry to selectively power corrosion preventative device 900, including display 960, or LEDs 982 described in greater detail below. This allows the power supply 966 to save energy and ensure a long life to the corrosion preventative device 900.

The LEDS 982 may serve as a timing element or indicator device 950. A user may depress a button, such as button 905, that begins a time counting sequence calculated by the device controller 964. Each LED of LEDS 982 may be of a different color which illuminate based on the passage of time. For example, and without limitation, one such LED may be blue and indicate that the corrosion preventative device 900 is within its effective lifetime. One such LED of LEDs 982 may be red and may activate when the device controller reaches a count associated with the end life of the corrosion preventative device 900. In this way, the corrosion preventative device 900 visually communicates with a user that the device is expired.

With reference to FIGS. 9 and 10, it is to be appreciated that if the corrosion preventative device 900 is placed within a gun vault 1000 and the door 1010 is closed, the ability of the corrosion preventative device 900 to transmit signals outside the vault 1000 will be limited due the Faraday Cage effect of the closed vault. In some embodiments, the corrosion preventative device 900 is configured to detect when the vault 1000 is open. This may be done through the use of on-board sensors (including those discussed above), motion sensors deployed within the control system configured to detect a movement, or a door and photosensors configured to detect changes in light. In this way, the corrosion preventative device 900 only transmits data when the sensors provide data that indicate that the vault door 1010 may be open.

While considerable emphasis has been placed herein on the structures and configurations of the preferred embodiments of the disclosure, it will be appreciated that other embodiments, as well as modifications of the embodiments disclosed herein, can be made without departing from the principles of the disclosure. These and other modifications of the preferred embodiments, as well as other embodiments of the disclosure, will be obvious and suggested to those skilled in the art from the disclosure herein, whereby it is to be distinctly understood that the foregoing descriptive matter is to be interpreted merely as illustrative of the present disclosure and not as a limitation thereof.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

What is claimed:

1. A corrosion preventative device configured to emit vapor from a corrosion-inhibiting material to protect metallic articles, said corrosion preventative device comprises a body, said body includes an interior cavity, at least one vent is formed of a plurality of apertures, and a timing element, said interior cavity is configured to house the corrosion-inhibiting material, said plurality of apertures of the at least one vent configured to release said vapor of the corrosion-inhibiting material from the interior cavity, said timing element is configured to indicate an operational time of the corrosion preventative device, said timing element further comprises a migration medium, said migration medium configured to permit a flow of liquid across said migration medium, said flow of liquid corresponding to the operational time of said corrosion preventative device.

2. The corrosion preventative device of claim 1, wherein said operational time is indicative of an amount of time said corrosion preventative device actively releases said vapor and/or a remaining life of said corrosion preventative device.

3. The corrosion preventative device of claim 1, wherein said timing element further comprises a button, said button configured to rupture a sealed reservoir containing said fluid.

4. The corrosion preventative device of claim 1, wherein said timing element further comprises one or more LEDs configured to illuminate based on said operational time.

5. A corrosion preventative device configured to emit vapor from a corrosion-inhibiting material to protect metallic articles, said corrosion preventative device comprises a body, said body includes an interior cavity, at least one vent is formed of a plurality of apertures, and a timing element, said interior cavity is configured to house the corrosion-inhibiting material, said plurality of apertures of the at least one vent configured to release said vapor of the corrosion-inhibiting material from the interior cavity, said timing element is configured to indicate an operational time of the corrosion preventative device, said timing element further comprises a time indicator panel, said time indicator panel including time information in the form of date information and/or seasonal information corresponding to the operational time of said corrosion preventative device.

6. The corrosion preventative device of claim 5, wherein said time indicator panel further comprises a deformable element oriented over one or more recess cavities formed in said body of the corrosion preventative device.

7. The corrosion preventative device of claim 6, wherein said deformable element is positioned next said date information and/or seasonal information that are configured to indicate said time information.

8. The corrosion preventative device of claim 1, wherein said timing element is separate from said corrosion preventative device and includes an adhesive for attachment to said body of the corrosion preventative device.

9. The corrosion preventative device of claim 1, wherein said timing element is integrated with said body of said corrosion preventative device.

10. The corrosion preventative device of claim 1, wherein said timing element is integrated with a packaging material of said corrosion preventative device.

11. A corrosion preventative device configured to emit vapor from a corrosion-inhibiting material to protect metallic articles, said corrosion preventative device comprises a body and a digital display system, said body includes an interior cavity, at least one vent is formed of a plurality of apertures, and a timing element, said interior cavity is configured to house the corrosion-inhibiting material, said plurality of apertures of the at least one vent configured to release said vapor of the corrosion-inhibiting material from the interior cavity, said timing element is configured to indicate an operational time of the corrosion preventative device, a said digital display system configured to display said operational time and/or an environmental condition of the corrosion preventative device.

12. The corrosion preventative device of claim 11, further comprising a communication interface that is configured to communicate with a remote device and transmit said operational time and/or said environmental condition of the corrosion preventative device to said remote device.

13. The corrosion preventative device of claim 1, wherein said body includes a top cover and a base, said top cover configured to connect to said base and define said interior cavity.

14. The corrosion preventative device of claim 1, wherein said body includes an outward material projection configured to facilitate mounting of said corrosion preventative device in a desired location.

15. The corrosion preventative device of claim 1, further comprising one or more tethering mechanisms that are configured to mount said corrosion preventative device in a desired location.

16. A method for protecting metallic articles that comprises the steps of:

providing a corrosion preventative device configured to emit vapor from a corrosion-inhibiting material to protect said metallic articles, said corrosion preventative device includes a body, said body includes an interior cavity, at least one vent is formed of a plurality of apertures, and a timing element, said interior cavity is configured to house the corrosion-inhibiting material, said plurality of apertures of the at least one vent are configured to release said vapor of the corrosion-inhibiting material from the interior cavity, said timing element is configured to indicate an operational time of the corrosion preventative device;

placing said corrosion preventative device in a storage container; and transmitting said operational time of said corrosion preventative device to a remote device.

17. The method of claim 16, further comprising displaying said operational time to indicate an amount of time said corrosion preventative device actively releases said vapor and/or a remaining life of said corrosion preventative device remaining of the corrosion preventative device.

18. A system configured to emit vapor from a corrosion-inhibiting material to protect metallic articles, said system comprising the steps of:

a corrosion preventative device, said corrosion preventative device includes a body having an interior cavity configured to house said corrosion-inhibiting material, at least one vent is formed of a plurality of apertures configured to release said vapor of the corrosion-inhibiting material from the interior cavity, and a timing element configured to indicate an operational time of said corrosion preventative device;

a storage container, said storage container configured to house said metallic articles, said corrosion preventative device being mounted within said storage container; and, a digital display, said digital display configured in electronic communication with said corrosion preventative device and configured to display information about said corrosion preventative device and/or an environmental condition of said storage container.

* * * * *